US006775908B2

(12) United States Patent
Ohara et al.

(10) Patent No.: US 6,775,908 B2
(45) Date of Patent: Aug. 17, 2004

(54) PRODUCTION METHOD OF CAM LOBE PIECE OF ASSEMBLED CAMSHAFT

(75) Inventors: Yujiro Ohara, Kanagawa (JP); Hiroshi Takano, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 29 days.

(21) Appl. No.: 10/347,482

(22) Filed: Jan. 21, 2003

(65) Prior Publication Data

US 2003/0159284 A1 Aug. 28, 2003

(30) Foreign Application Priority Data

Jan. 24, 2002 (JP) ..... 2002-015229
May 29, 2002 (JP) ..... 2002-154988

(51) Int. Cl.[7] ..... B23P 15/00
(52) U.S. Cl. ..... 29/888.1; 29/557; 72/355.6
(58) Field of Search ..... 29/888.1, 557, 29/558; 72/355.6, 344, 355.2, 376, 453.01

(56) References Cited

U.S. PATENT DOCUMENTS 6,250,128 B1 * 6/2001 Ando et al. ..... 72/355.6

FOREIGN PATENT DOCUMENTS

| | | | |
|---|---|---|---|
| JP | 4-350307 | A | 10/1992 |
| JP | 5-104209 | A | 4/1993 |
| JP | 8-109809 | A | 4/1996 |
| JP | 9-276976 | A | 10/1997 |
| JP | 9-280013 | A | 10/1997 |
| JP | 2767323 | B2 | 4/1998 |
| JP | 11-47877 | A | 2/1999 |

* cited by examiner

*Primary Examiner*—I Cuda Rosenbaum
(74) *Attorney, Agent, or Firm*—Foley & Lardner LLP

(57) ABSTRACT

A method of producing a cam lobe piece of an assembled camshaft in a valve operating system for an internal combustion engine. The method comprises (a) forming a profile of the cam lobe piece by upsetting a material under forging to obtain an intermediately formed body; (b) piercing a central portion of the intermediately formed body to form a shaft bore; and (c) ironing an inner peripheral surface of the pierced intermediately formed body to form unevenness at the inner peripheral surface, all accomplished by cold working. The material at the forming the profile of the cam lobe piece has a first section located on a side of a cam nose of the cam lobe piece, and a second section located longitudinally opposite to the first section. The material has a thickness which gradually increases in a direction from the second section to the first section.

14 Claims, 20 Drawing Sheets

FIG.1C (CROSS-SECTIONAL SHAPE)

FIG.4A
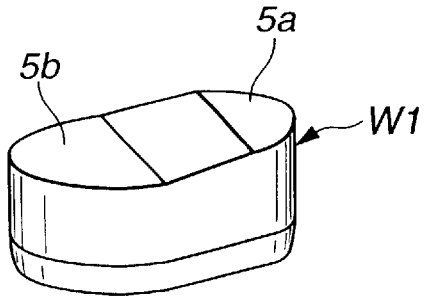
FIG.4B
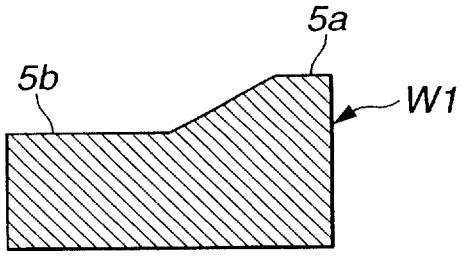
CROSS-SECTIONAL SHAPE
FIG.5A
FIG.5B
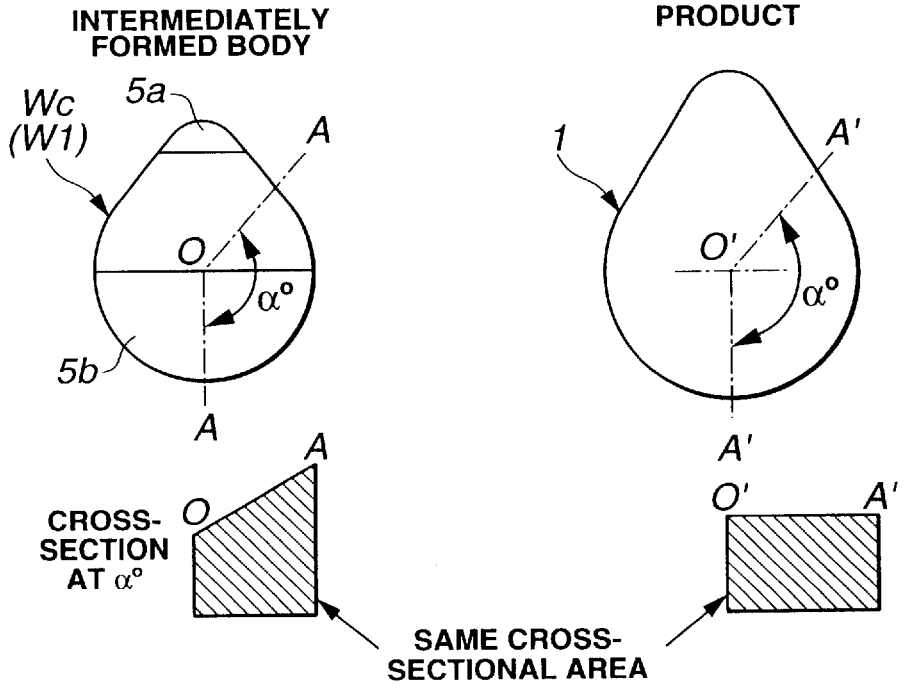

< AT FORMING INITIAL STAGE >

< AT FORMING COMPLETION >

CASE OF PARALLEL TWO PLANES EXISTING

< AT FORMING INITIAL STAGE >

< AT FORMING COMPLETION >

CASE OF NO PARALLEL TWO PLANES EXISTING 65
59A
W1
64
54

PRODUCTION METHOD OF CAM LOBE PIECE OF ASSEMBLED CAMSHAFT

BACKGROUND OF THE INVENTION

This invention relates to improvements in a production method of a cam lobe piece of an assembled camshaft which functions as a main element in a valve operating system for an internal combustion engine, and more particularly to the production method of the cam lobe piece of the assembled camshaft arranged such that the cam lobe piece as a forging is fixedly mounted on a hollow shaft upon diametrical expansion treatment of the hollow shaft.

The cam lobe piece of the assembled camshaft is conventionally formed of a sintered material or a forging. In case of the cam lobe piece formed of the forging, a high carbon steel (for example, S70C or S55C according to Japanese Industrial Standard) has been used as the material for the cam lobe piece in order to particularly obtain a high surface hardness. The forging upon being forged is subjected to hardening so as to be used as the final product of the cam lobe piece. In general, the cam lobe piece of the forging is formed under hot forging excellent for forming the cam lobe piece as disclosed in Japanese Patent Provisional Publication Nos. 9-276976 and 9-280013.

Now, the built-up camshaft is assembled by press-fitting a pipe-shaped shaft into the shaft bore of the cam lobe piece. At this time, a press-fit pressure and a assembly precision between the shaft and the cam lobe piece are ensured by a press-fit amount. Consequently, a high precision is required for the outer peripheral dimension of the shaft and the inner peripheral dimension of the cam lobe piece. However, in case of the forged cam lobe piece formed by the hot forging using the high carbon steel as the material, production of oxide scale and thermal shrinkage occur in the forging during the hot forging, thereby inviting dimensional change of the forging. Thus, the forged cam lobe piece cannot obtain a sufficient dimensional precision required for a part of the assembled camshaft. In view of this, in order to obtain a required inner peripheral dimension of the cam lobe piece, it is required to apply finishing such as cutting (for example, broaching) or cold plastic working onto the formed cam lobe piece at a separate step. This increases the number of steps and man-hour for managing intermediate stocks, thus inviting cost-up in production.

Additionally, in case of the forged cam lobe piece formed of the high carbon steel, the formed cam lobe piece is required to be subjected to hardening in order to secure its surface hardness, in which quenching crack may occur. For the particularity of the material itself, it is impossible to completely get rid of the quenching crack during the hardening. As a result, inspection for judgment as to whether the quenching crack has occurred or not and selection for the hardened products having the quenching crack are required in order to previously prevent occurrence of damage during a press-fitting assembly and insufficient press-fitting pressure due to the quenching crack. This lowers yield of the product and increases the number of steps in production, thereby further contributing to the cost-up in production.

In view of the above, a production method of the cam lobe piece employing cold forging as a basic working has been proposed in place of that employing the hot forging, as disclosed in Japanese Patent No. 2767323.

BRIEF SUMMARY OF THE INVENTION

However, the cold forging is low in forgeability of the material (flowability of the fillet of the material) as compared with the hot forging, and therefore not only defects such as underfill tend to occur but also a forming load applied to a die unavoidably increases if a deformed amount of the material is sufficiently decreased during plastic deformation made from the material to the required product, thereby making wear of the die severe thus contributing to shortening the life of the die.

Particularly in case that a solid cylindrical material is axially upset and compressed, the material is bulged radially outwardly in equal amounts throughout its outer periphery, and therefore it is relatively easy to form the material into a simple circular shape or the like. However, it is difficult to directly form the material into a particular shape which is obtained by synthesizing a base circle section and a rounded projected section (having a notably small radius of curvature as compared with the base circle section) serving as a cam nose in the product, without occurrence of underfill. As a result, it is required to increase the number of steps for production so as to make plastic deformation from the material to the product little by little throughout the increased number of steps. This not only requires the forging facility of the large-size and the high cost but also prolongs time required for working thereby contributing to lowering in productivity.

It is, therefore, an object of the present invention to provide an improved production method of a cam lobe piece of an assembled camshaft, which can effectively overcome drawbacks encountered in conventional production methods of the cam lobe piece.

Another object of the present invention is to provide an improved production method of a cam lobe piece of an assembled camshaft, by which the cam lobe piece of a high precision can be produced without occurrence of its underfill and by a small number of production steps though employing a cold forging as a premise.

An aspect of the present invention resides in a method of producing a cam lobe piece of an assembled camshaft. The method comprises (a) forming a profile of the cam lobe piece by upsetting a material in a direction of thickness of the cam lobe piece under forging to obtain an intermediately formed body; (b) piercing a central portion of the intermediately formed body to form a shaft bore in the intermediately formed body; and (c) ironing an inner peripheral surface of the pierced intermediately formed body to form unevenness at the inner peripheral surface. In the method, the forming the profile of the cam lobe piece, the piercing the central portion of the intermediately formed body and the ironing the inner peripheral surface of the pierced intermediately formed body are accomplished by cold working. Additionally, the material at the forming the profile of the cam lobe piece has a shape including first and second side surfaces which are opposite to each other in the direction of thickness of the cam lobe piece. The first side surface includes first and second surface portions which are substantially parallel with the second side surface. The first surface portion forms part of a first section located on a side of a cam nose of the cam lobe piece. The second surface portion forms part of a second section which is located longitudinally opposite to the first section. The first surface portion is farther from the second side surface than the second surface portion so that a thickness of the material gradually increases in a direction from the second section to the first section.

Another aspect of the present invention resides in a method of producing a cam lobe piece of an assembled camshaft. The method comprises (a) forming a profile of the cam lobe piece by upsetting a material in a direction of thickness of the cam lobe piece under forging to obtain an intermediately formed body; (b) piercing a central portion of the intermediately formed body to form a shaft bore in the intermediately formed body; and (c) ironing an inner peripheral surface of the pierced intermediately formed body to form unevenness at the inner peripheral surface. In the method, the forming the profile of the cam lobe piece, the piercing the central portion of the intermediately formed body and the ironing the inner peripheral surface of the pierced intermediately formed body are accomplished by cold working. Additionally, the material to be supplied for the forming the profile of the cam lobe piece has a section corresponding a cam nose of the cam lobe piece. The section having a rounded end portion has a radius of curvature substantially equal to that of a rounded end portion of the cam nose of the cam lobe piece. The radius of curvature of the material is formed prior to the forming the profile of the cam lobe piece.

A further aspect of the present invention resides in a method of producing a cam lobe piece of an assembled camshaft. The method comprises (a) forming a profile of the cam lobe piece by upsetting a material in a direction of thickness of the cam lobe piece under forging to obtain an intermediately formed body; (b) piercing a central portion of the intermediately formed body to form a shaft bore in the intermediately formed body; and (c) ironing an inner peripheral surface of the pierced intermediately formed body to form unevenness at the inner peripheral surface. In the method, the material has a first section located on a side of a cam nose of the cam lobe piece, and a second section longitudinally opposite to the first section. Additionally, each of the forming the profile of the cam lobe piece, the piercing the central portion of the intermediately formed body and the ironing the inner peripheral surface of the pierced intermediately formed body is carried out in a condition where the first section of the material is located below relative to the second section of the material under a cold working and by using a multi-stage former in which compressive forces are applied laterally to the material.

BRIEF DESCRIPTION OF THE DRAWINGS

In the drawings, like and same reference numerals designate like and same parts and elements throughout all the figures, in which:

FIG. 1C is a series of cross-sectional views which correspond respectively to perspective views of FIG. 1B;

FIG. 4A is a perspective view of an intermediately formed body obtained in the course of the first embodiment production method according to the present invention;

FIG. 4B is a vertical cross-sectional view of the intermediately formed body of FIG. 4A;

FIG. 5A is a side view of the intermediately formed body obtained in the course of the first embodiment production method, together with a cross-sectional view at an angle of $\alpha°$ in the side view;

FIG. 5B is a side view of the product obtained by first embodiment production method, together with a cross-sectional view at an angle of $\alpha°$ in the side view;

FIG. 29A is an explanatory view similar to FIG. 26 but illustrating the locational relationship between the cavity of the die and a material at the first state, in case that the material is column-like;

FIG. 29B is an explanatory view similar to FIG. 28A but illustrating the locational relationship at a second state after the first state of FIG. 29A;

DETAILED DESCRIPTION OF THE INVENTION

Referring now to FIGS. 1 to 21, more specifically to FIG. 1, an embodiment of a producing method of a cam lobe piece, according to the present invention will be discussed. The cam lobe piece is a part of a so-called assembled camshaft (not shown) including a cylindrical hollow shaft (not shown). The hollow shaft is inserted into a shaft bore of the cam lobe piece and fixed to the inner periphery of the cam lobe piece upon diametrical expansion of the hollow shaft.

Figures 1A, 1B:
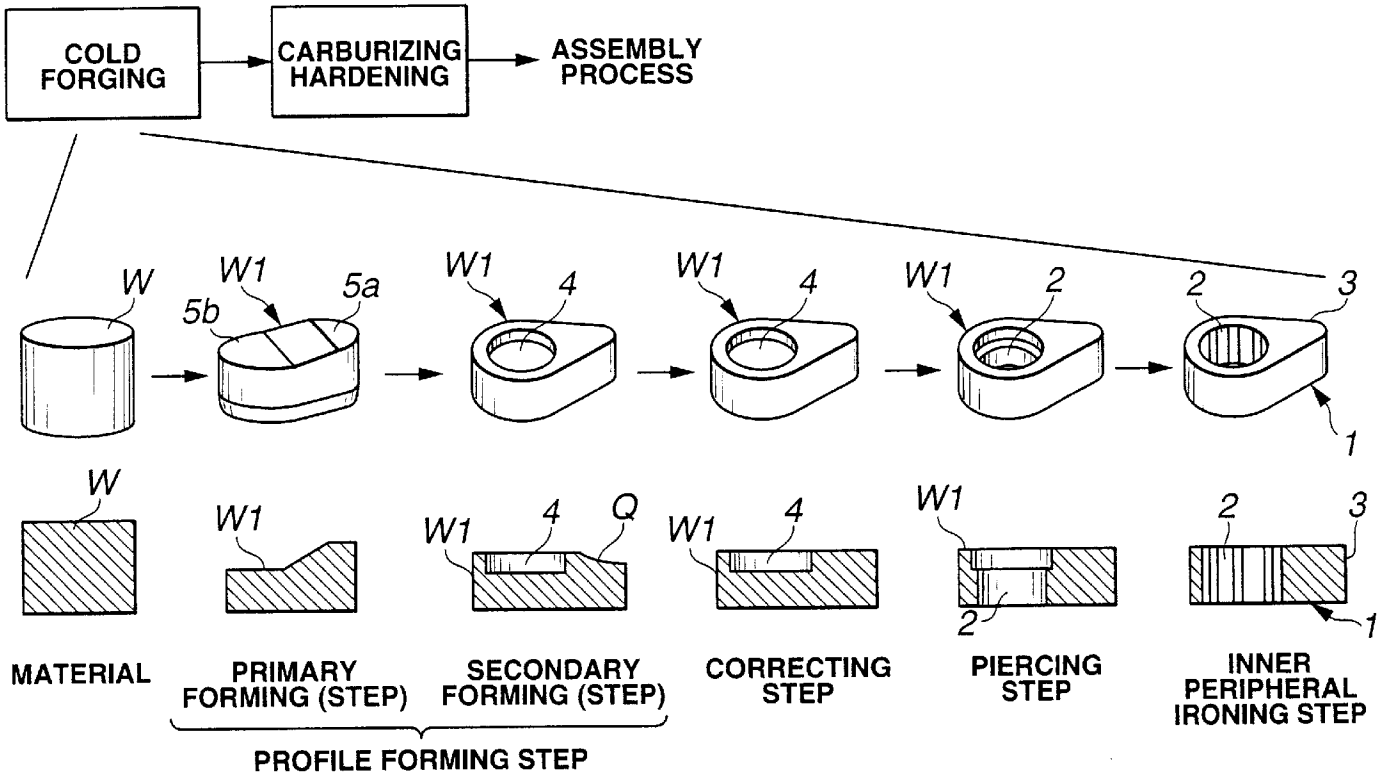
FIG. 1A is a block diagram of a process for producing an assembled camshaft including a cam lobe piece produced according to a production method of the present invention.
FIG. 1B is a series of perspective views showing a first embodiment of the production method of the cam lobe piece, according to the present invention.

As shown in FIG. 1A, the cam lobe piece is subjected to a cold forging, and then to a carburizing hardening, and lead to an assembly process so as to be assembled as the assembled camshaft. The mode of the production method of this embodiment is established on the premise that a low carbon steel or a low carbon alloy steel is used as the material W of cam lobe piece 1. An example of the low carbon alloy steel is SCr 420 H steel (having a carbon C content of 0.2% by weight) according to JIS (Japanese Industrial Standard). The material having a low carbon content possesses a good formability in its cold condition, and therefore it is possible to form the cam lobe piece at a stretch from the material W under the cold forging. As a result, as discussed after, a cold forming for forming a profile (shape) of cam lobe piece 1 and a cold forming for forming an inner diametrical shape of cam lobe piece 1 can be carried out at succeeding steps, thereby making it possible to achieving a cost down upon reducing the number of steps and removing stocks between the succeeding steps.

Figure 8:
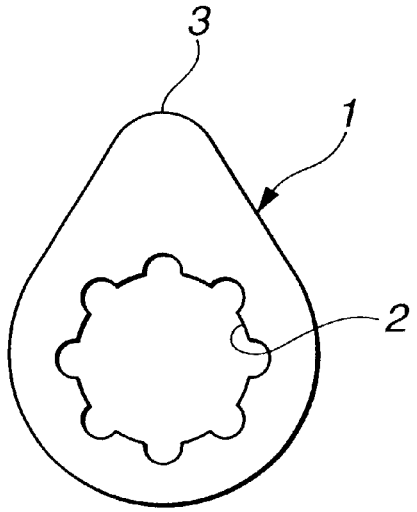
FIG. 8 is a side view of the cam lobe piece which has been completed through an inner peripheral ironing step in FIGS. 1B and 1C.

The process of the cold forging includes a plurality of steps as shown in FIGS. 1B and 1C, i.e., a profile forming step for forming the solid and cylindrical (column-like) material W into the shape of cam lobe piece 1, a correcting step for adjusting the thickness dimension of cam lobe piece 1, a piercing step for forming a shaft bore at the central portion of cam lobe piece 1, and an inner peripheral ironing step for accomplishing a finish-forming to obtain an uneven shape at the inner peripheral surface of shaft bore 2. The deformed shape is obtained, for example, by forming spline-like unevenness (as shown in FIG. 8) at the inner peripheral surface of shaft bore 2. All these steps of from the profile forming step to the inner peripheral ironing step can be successively carried out by a multiple step forging press (multi-stage cold former), thereby achieving improved productivity and a cost down upon shortening a cycle time.

The profile forming step includes a primary forming step and a secondary forming step. At the primary forming step, the cylindrical material W is axially upset to be deformed into the generally elliptical shape in section, thereby obtaining an intermediately formed body W1. The intermediately formed body W1 has an upper surface or one side surface including first and second planes (or surface portions) 5*a*, 5*b* which are different in height level and are connected with each other through a sloped surface. In other words, first and second planes 5*a*, 5*b* are generally parallel with a lower surface or another side surface (not identified) of the intermediately formed body W1, in which first plane 5*a* is farther from the lower surface than second plane 5*b*. First plane 5*a* forms part of a first section (not identified) of the intermediately formed body W1 which section is located on a side of a cam nose or cam lobe of cam lobe piece 1. Second plane 5*b* forms part of a second section (not identified) of the intermediately formed body W which section is located longitudinally opposite to the first section. Accordingly, the thickness of the intermediately formed body W1 gradually increases from the second section to the first section.

At the secondary forming step, the intermediately formed body W1 having the stepped upper surface is further upset to be flattened so as to approach the profile shape of the formed body W1 to the shape of cam lobe piece 1 while press-forming a depression 4 at a position of shaft bore 2. The formation of the depression 4 is not necessarily required; however, this accomplishes distribution of the fillet of the material at an early stage and therefore effective for reducing as much as possible a region which will become a scrap during the piercing step as discussed after.

In case that the profile forming step is completed with this secondary forming step, underfill Q still may occur at a part of the intermediately formed body W1. In view of this, the intermediately formed body W1 is further upset in the thickness direction while further adjusting its profile shape at the correcting step succeeding to the profile forming step, thereby correcting the profile shape of the intermediately formed body W1 to be prevented from occurrence of the under fill Q.

At the piercing step, a portion of the intermediately formed body W1 having depression 4 is punched to form shaft bore 2. At the inner peripheral ironing step, shaft bore 2 undergoes ironing under pressure of a mandrel thereby forming spline-like unevenness at the inner peripheral surface of shaft bore 2 so as to obtain a splined shaft bore.

Figure 2A:
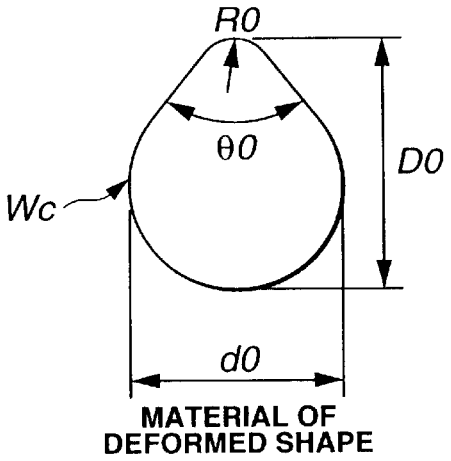
FIG. 2A is an explanatory view showing the profile of a material of the deformed shape usable in the first embodiment production method according to the present invention.
Figure 2B:
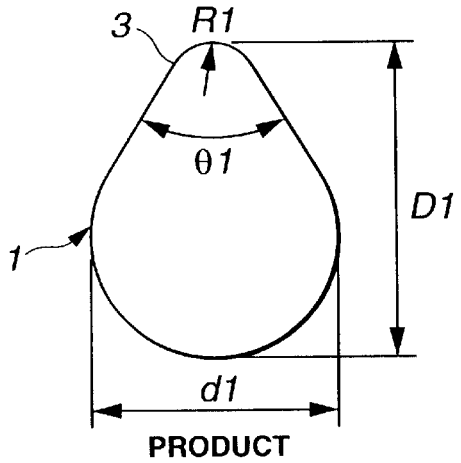
FIG. 2B is an explanatory view showing the profile of a product obtained by the first embodiment production method in which the material of FIG. 2A is used.
Figure 3:
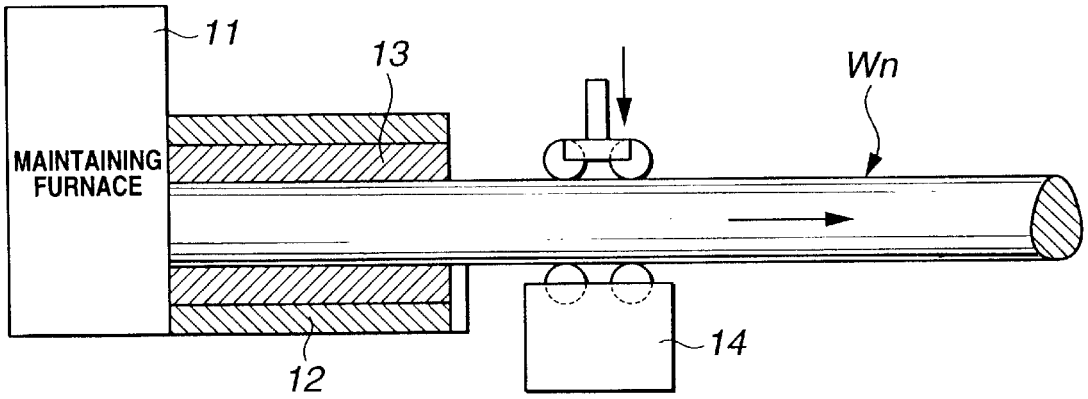
FIG. 3 is an explanatory view showing the outline of a continuous casting method for obtaining a rod-like material.

Although the material W has been shown as being column-like in FIG. 1, it is preferable to use as the material W a material Wc having a deformed (profile) shape similar to the profile shape of cam lobe piece 1 as a final product (See FIG. 2B), as shown in FIG. 2A. Such a material Wc having the deformed shape may be formed, for example, by a continuous casting method as shown in FIG. 3. More specifically, a rod-like material Wn having the deformed shape in cross-section is cast-formed by drawing molten metal in maintaining furnace 11 through die 13 by drawing device 14, in which the die is compulsorily cooled with water or the like in cooling device 12. A technique of this kind is known from Japanese Patent Provisional Publication No. 5-104209.

The material W (or Wc) may be obtained by previously cutting a rod-like material into a short material having a certain dimension at a step preceding to the profile forming step, regardless of whether the material W is the column-like or the deformed shape, followed by being subjected to the profile forming step shown in FIG. 1. However, it is preferable that the rod-like material is directly supplied to the multiple step forging press, in which the rod-like material is at an initial step and then introduced as it is into the profile forming step as the later step thereby shortening the process and removing stocks between the steps. In addition to the direct forming by the above continuous casting method, the material Wc having the above deformed shape may be formed by drawing molten metal while casting the molten metal into a rod-like shape and thereafter by forming the rod-like material into the deformed shape under rolling or the like, followed by introducing the material of the deformed shape to a cutting step.

In case that the material Wc has been previously formed into the deformed shape as discussed above, movement of the material in the direction of a long diameter (discussed after) of cam lobe piece 1 or the intermediately formed body W1 is suppressed during forging, and therefore it can be easily accomplished to form cam lobe piece 1 having a large difference between the long diameter and a short diameter (discussed after), i.e., a cam lobe piece having a large cam lift amount or highly sharpened cam nose 3, while providing effectiveness for reducing the number of the steps within the profile forming step. Additionally, the deformation amount of the material during the deformation process from the shape of the material to the shape of cam lobe piece 1 is decreased thereby reducing the load applied to a die thus providing an advantage of prolong the life of the die. Accordingly, it is possible to further decrease the deformation amount of the material at the primary forming step, so that it may be made to substantially combine the primary and secondary forming steps in FIG. 1C to constitute the profile forming step as a single step, according to the size or the like of cam lobe piece 1.

As illustrated in FIG. 2A showing the profile of the material Wc, the material Wc of the deformed shape is defined by the radius of curvature R0 of the rounded end portion of a section corresponding to cam nose 3, the opening angle θ0 of cam nose 3, and the ratio D0/d0 between the long diameter (axis) D0 and the short diameter (axis) d0. Here, it is preferable that the radius of curvature R0, the opening θ0 and the ratio D0/d0 of the material We are respectively the same as the radius of curvature R1 of cam nose 3, the opening angle θ1 of cam nose 3, and the ratio. D1/d1 between the long diameter D1 and the short diameter d1 in the product as illustrated in FIG. 2B showing the profile of the product or cam lobe piece 1. However, if all the above conditions (the radius of curvature, the opening angle and the ratio) cannot be met or set the same under forming restrictions such as a forming limit and a facility ability limit and the like, it is preferable to conform the shape the material Wc to that of cam lobe piece 1 upon selecting the above conditions in the priority order of the first priority for the radius of curvature R0 of the rounded end portion of the section corresponding to cam nose 3, the second priority for the opening angle θ0 of cam nose 3, and the third priority for the ratio D0/d0 between the long diameter D0 and the short diameter d0. It is to be noted that the priority order corresponds to the degrees or orders in difficulty for obtaining precision of shape when the intermediately formed body W1 having the shape of cam lobe piece 1 is formed from the column-like material W in the profile forming step in FIGS. 1B and 1C.

Here, the above-mentioned opening angle θ of cam nose 3 is an angle formed between first and second tangential lines which connect a base circle and the curvature (R0, R1) of cam nose 3 or the section corresponding to the cam nose 3 on the assumption that the cam lobe piece 1 or the material Wc corresponding to the cam lobe piece 1 is a tangential cam, as shown in FIGS. 2A and 2B.

The intermediately formed body W1 obtained upon completion of the primary forming in the profile forming step in FIGS. 1B and 1C has the following shape: The upper surface or one side surface includes first and second planes (or surface portions) 5*a*, 5*b* which are different in height level and are connected with each other through the sloped surface. In other words, first and second planes 5*a*, 5*b* are generally parallel with the lower surface or another side surface of the intermediately formed body W1, in which first plane 5*a* is farther from the lower surface than second plane 5*b*. First plane 5*a* forms part of the first section of the intermediately formed body W1 which section is located on the side of the cam nose or cam lobe of cam lobe piece 1. Second plane 5*b* forms part of the second section of the intermediately formed body W which section is located longitudinally opposite to the first section. Accordingly, the thickness of the intermediately formed body W1 gradually increases from the second section to the first section. This arrangement or idea is clearly illustrated also in FIG. 4. It will be understood that this idea may be applied to the material Wc of the deformed shape, in which the cross-sectional area of the intermediately formed body W1 of the intermediate shape is the same as that of cam lobe piece 1 as the product, at the same angle $\alpha°$ as illustrated in FIGS. 5A and 5B. In FIG. 5A, the upper figure shows the upper surface or one side surface of the material Wc or the intermediately formed body W1, while the lower figure shows the cross-sectional area at the angle $\alpha°$ of the upper figure. In FIG. 5B, the upper figure shows the upper surface or one side surface of cam lobe piece 1 (the product), while the lower figure shows the cross-sectional area at the angle $\alpha°$ of the upper figure.

For a product such as cam lobe piece 1 which is asymmetrical in shape and one-sided in volume, first the intermediately formed body W1 is formed to have such a shape that the volume of the material is ensured in the thickness direction, and then the thickness dimension of the intermediately formed body W1 is gradually uniformalized to move the material and fill a section corresponding to cam nose 3 with the material. This promotes the flow or plastic flow of the material toward the side of cam nose 3 which conventionally tends to become insufficient in filling with the material, thereby making it possible to form cam lobe piece 1 having further sharpened cam nose 3 while improving a fraction defective due to underfill and the like. It is a matter of course that such promotion of the flow of the material reduces load required for forming thereby contributing to prolonging the life of the die.

Figure 6A:
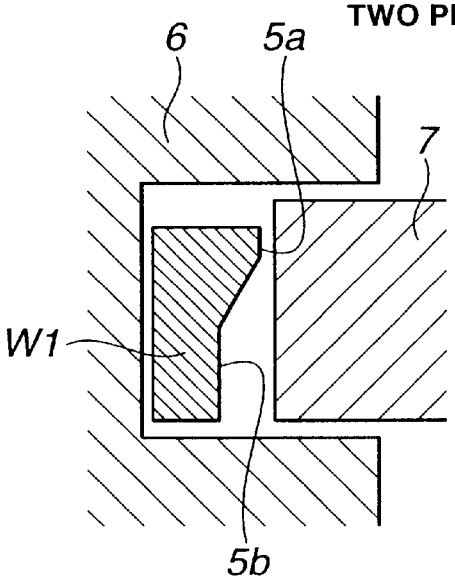
FIG. 6A is a fragmentary cross-sectional explanatory view showing the state of the intermediately formed body of FIGS. 4A and 4B and FIG. 5A at the initial stage of a secondary forming sep of a profile forming step in FIGS. 1B and 1C.
Figure 6B:
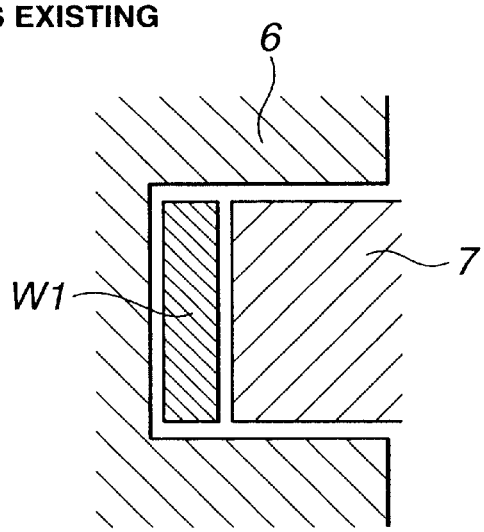
FIG. 6B is a fragmentary cross-sectional explanatory view showing the state of the intermediately formed body of FIGS. 4A and 4B and FIG. 5A at the completion of the secondary forming step.
Figure 7A:
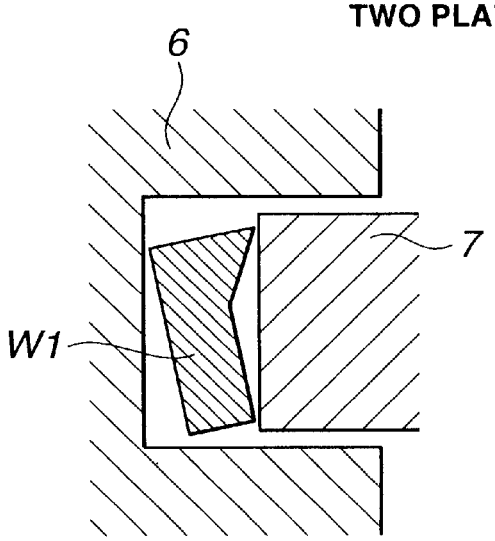
FIG. 7A is a fragmentary cross-sectional explanatory view showing the state of an intermediately formed body in case that no parallel two planes exist at a side surface of the intermediately formed body at the initial stage of the secondary forming step.
Figure 7B:
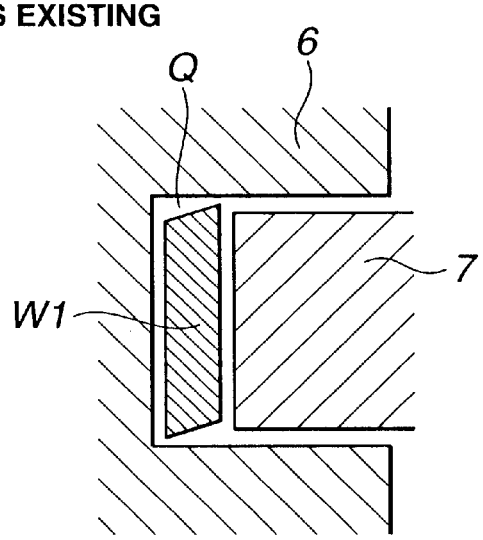
FIG. 7B is a fragmentary cross-sectional explanatory view showing the state of the intermediately formed body in case that no parallel two planes exist at the side surface of the intermediately formed body at the completion of the secondary forming step.

As discussed above, the intermediately formed body W1 originated from the material W or Wc has two planes 5*a*, 5*b* which are different in height, and therefore the attitude of the intermediately formed body W is stabilized at the secondary forming step succeeding from the primary forming step thereby particularly contributing to preventing occurrence of underfill. For example, as shown in FIGS. 6A and 6B, in case that the intermediately formed body W1 takes such a shape as to have two parallel planes 5*a*, 5*b* which are different in height, the intermediately formed body W1 can rightly make its plastic deformation during the secondary forming (See FIG. 6A) in which upsetting for the intermediately formed body W1 is made by die 6 and punch 7 as shown in FIG. 6B, thereby obtaining the deformed body W1 having a rectangular cross-section as shown in FIG. 6B. This is advantageous for preventing occurrence of underfill. In contrast, in case that the intermediately formed body W1 does not takes such a shape as to have two parallel planes 5*a*, 5*b* which are different in height, the intermediately formed body W1 makes its tumbling-down phenomena (See FIG. 7A) and therefore is deformed into trapezoidal type or rhomb as shown in FIG. 7B, thereby unavoidably making underfill or the like.

As shown in FIGS. 1B and 1C, depression 4 is formed at the secondary step in the profile forming step. This is made to positively move the material to the portion which will become cam nose 3 and to provide a base hole serving as a starting point for boring during the piercing at the later step. By simultaneously forming depression 4 with the secondary forming, the material surrounding depression 4 is raised thereby unavoidably making ununiformity in thickness. In view of this, the correcting step succeeding the profile forming step is carried out to correct the uniformity in thickness of the intermediately formed body W1.

At the piercing step, after the punching (forming) is completed to form shaft bore 2, shaft bore 2 is subjected to the ironing by inserting the pin-like mandrel or the like having the same cross-sectional shape as the hollow shaft (on which cam lobe piece 1 is to be mounted) into shaft bore 2 at the inner peripheral ironing step so that shaft bore 2 is finished to have such a shape of the splined bore. As a result, the product or cam lobe piece 1 having the shape shown in FIG. 8 is obtained.

Figure 9:
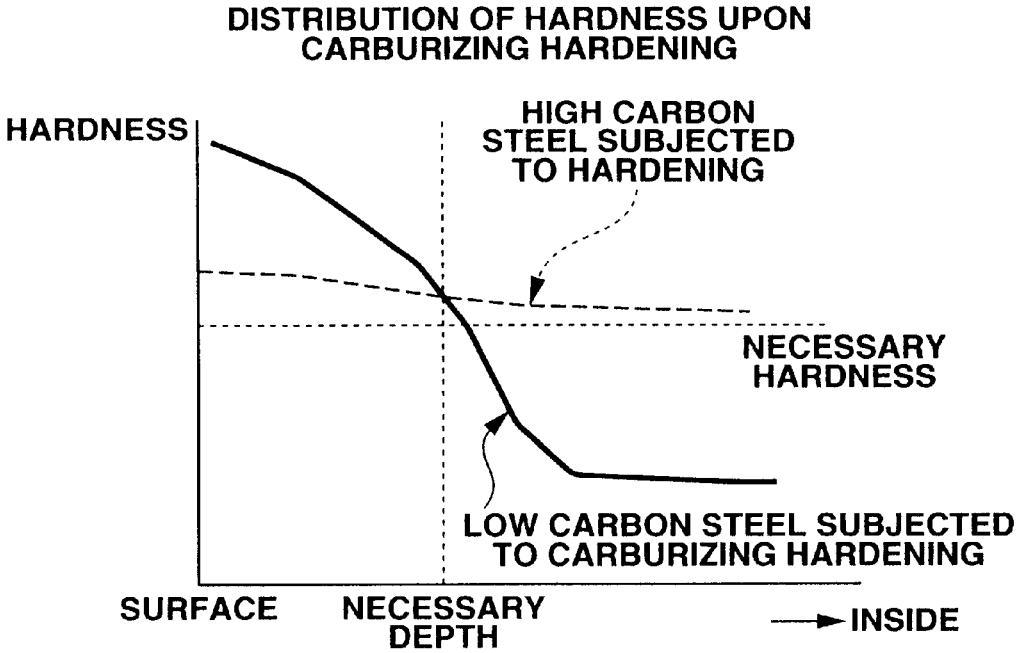
FIG. 9 is a graph showing a hardness distribution of the cam lobe pieces formed of a high carbon steel and of a low carbon steel after hardening.

Cam lobe piece 1 formed upon completion of the forging is then subjected to the carburizing hardening as shown in FIG. 1A so as to obtain a necessary surface hardness. In other words, the material W or Wc itself is insufficient in carbon amount at a surface portion dissimilarly to the a high carbon steel, and therefore the carburizing is accomplished at the later step. Cam lobe piece 1 (low carbon steel) subjected to the carburizing hardening is different in hardness distribution from a high carbon steel subjected to the hardening as shown in FIG. 9. The inner section (or inside) of cam lobe piece 1 subjected to the carburizing hardening is low in hardness.

Cam lobe piece 1 is finally assembled with the hollow shaft as an opposite member. First, the hollow shaft is inserted into the shaft bore of cam lobe piece 1. Then, the mandrel is inserted into the hollow shaft to enlarge the diameter of the hollow shaft thereby securely uniting the hollow shaft and cam lobe piece 1. At this time, an impact load is applied to cam lobe piece 1 during assembly of the hollow shaft and cam lobe piece 1. This may cause occurrence of crack in the cam lobe piece if the cam lobe piece is formed of a conventional material. In contrast, according to the present invention, the inner section of cam lobe piece 1 is low in hardness, which is serves as an advantage so that cam lobe piece 1 is improved in impact resistance thereby preventing occurrence of crack in cam lobe piece 1 during a treatment of enlarging the diameter of the hollow shaft. Particularly by causing the material W or Wc to previously contain boron (B), the impact strength of cam lobe piece 1 can be improved thereby providing advantages for preventing occurrence of crack in cam lobe piece during the hollow shaft diameter enlarging treatment.

Concrete method of producing the cam lobe piece by using a multiple step forging press will be explained with reference to FIGS. 10 to 21.

Figure 10:
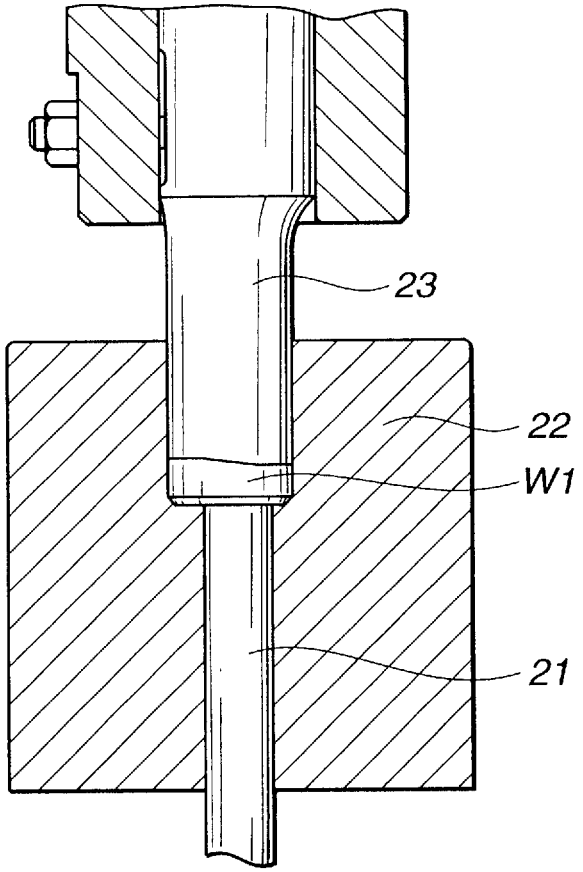
FIG. 10 is a fragmentary sectional view showing the working at the primary forming step of the profile forming step in FIGS. 1B and 1C.
Figure 11A:
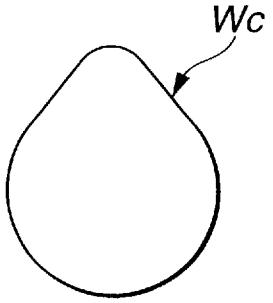
FIG. 11A is a side view of the material of the deformed shape usable at the primary forming step.
Figure 11B:
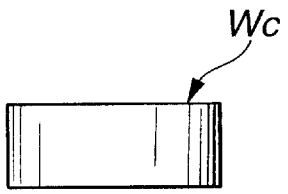
FIG. 11B is a plan view of the material of FIG. 11A.
Figure 12A:
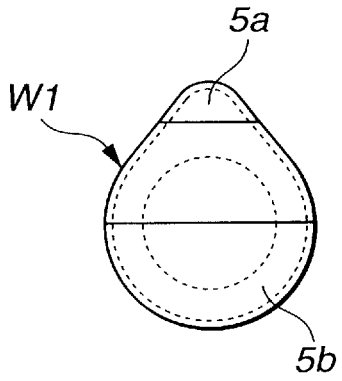
FIG. 12A is a side view of the material of the deformed shape, obtained at the primary forming step.
Figure 12B:
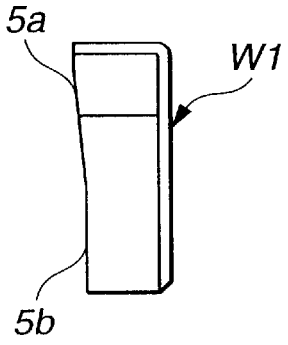
FIG. 12B is a plan view of the material of FIG. 12A.

FIG. 10 illustrates the primary forming step in the above-mentioned profile forming step, in which the material Wc of the deformed shape as show in FIGS. 11A and 11B is inserted into a die 22 provided with a knock-out pin 21, upon which the material Wc is upset by a punch 23. By this, as illustrated in FIGS. 12A and 12B, the intermediate formed body W1 (having the intermediate shape) of the material Wc has the following shape: The upper surface or one side surface includes first and second planes (or surface portions) 5*a*, 5*b* which are different in height level and are connected with each other through the sloped surface. In other words, first and second planes 5*a*, 5*b* are generally parallel with the lower surface or another side surface of the intermediately formed body W1, in which first plane 5*a* is farther from the lower surface than second plane 5*b*. First plane 5*a* forms part of the first section of the intermediately formed body W1 which section is located on the side of the cam nose or cam lobe of cam lobe piece 1. Second plane 5*b* forms part of the second section of the intermediately formed body W which section is located longitudinally opposite to the first section. Accordingly, the thickness of the intermediately formed body W1 gradually increases from the second section to the first section.

Figure 13:
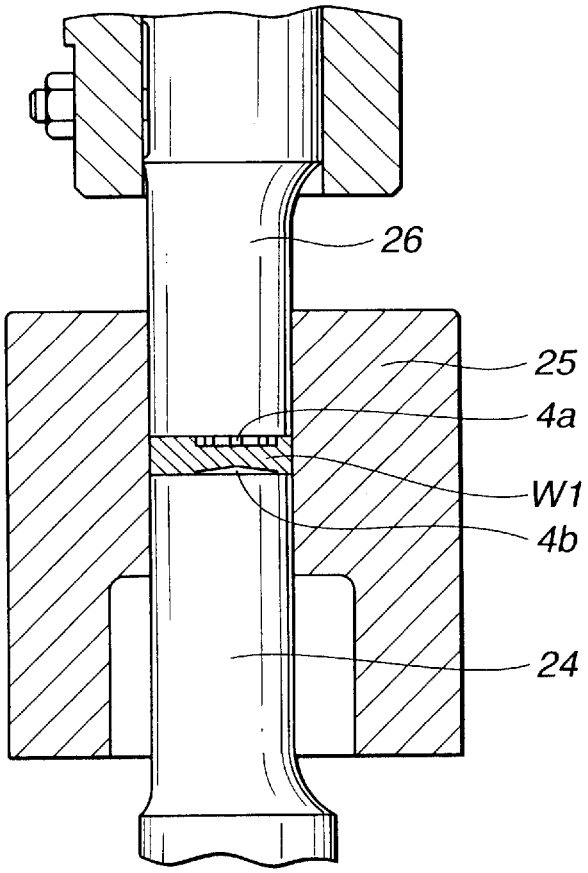
FIG. 13 is a fragmentary sectional view showing the working at the secondary forming step of the profile forming step in FIGS. 1B and 1C.
Figure 14A:
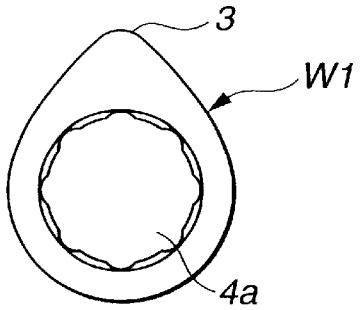
FIG. 14A is a side view of the intermediately formed body obtained at the secondary forming step of the profile forming step in FIGS. 1B and 1C.
Figure 14B:
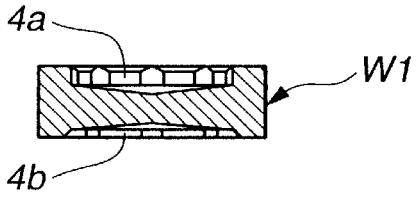
FIG. 14B is a sectional view of the intermediately formed body of FIG. 14A.

FIG. 13 illustrates the secondary forming step in the profile forming step, in which the intermediately formed body W1 is inserted in die 25 provided with a lower punch 24, upon which the intermediately formed body W1 is upset with upper punch 26 so that its (upper) surface is flattened to cancel the height difference between first and second planes 5*a*, 5*b* while depressions 4*a*, 4*b* are respectively punch-formed at opposite surfaces of the intermediately formed body W1. By this, the intermediately formed body W1 shown in FIGS. 14A and 14B is obtained. Depressions 4*a*, 4*b* function as the base holes for shaft bore 2 of the shape of the splined bore, and therefore each depression 4*a*, 4*b* takes a polygonal shape in cross-section in order to approach its shape to the shape of shaft bore 2.

Figure 15:
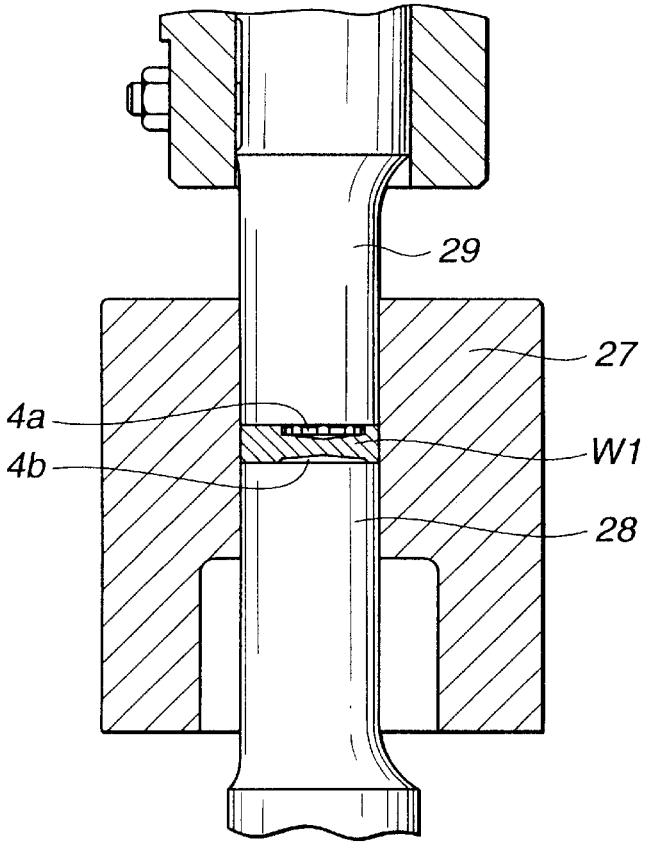
FIG. 15 is a fragmentary sectional view showing the working at a correcting step in FIGS. 1B and 1C.

FIG. 15 illustrates the correcting step succeeding the profile forming step, in which the intermediately formed body W1 as shown in FIGS. 14A and 14B is pressed and restrained in die 27 by lower punch 28 and upper punch 29 thereby correcting the shape of the intermediately formed body W1. As a result, the intermediately formed body W1 improved in shape-precision as shown in FIGS. 16A and 16B is obtained.

Figure 16A:
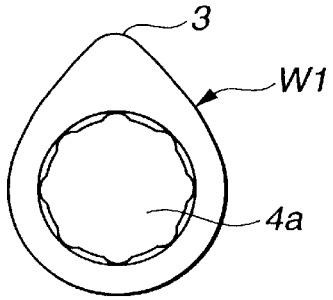
FIG. 16A is a side view of the intermediately formed body obtained at the correcting step in FIGS. 1B and 1C.
Figure 16B:
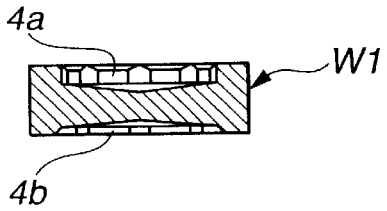
FIG. 16B is a sectional view of the intermediately formed body of FIG. 16A.
Figure 17:
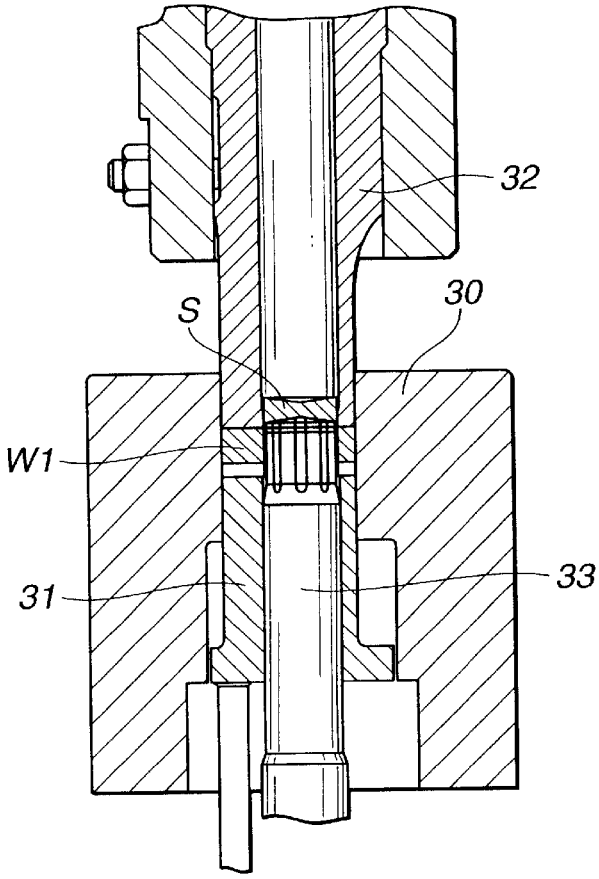
FIG. 17 is a fragmentary sectional view showing the working at a piercing step in FIGS. 1B and 1C.

FIG. 17 illustrates the piecing step in which the punch-forming is accomplished on the intermediately formed body W1 as shown in FIGS. 16A and 16B within die 30 under the shearing action of piercing punch 33 and upper punch 32. The tip end of piercing punch 33 is formed in the shape of a splined shaft, and therefore a scrap S is produced when the central portion of the intermediately formed body W1 is punched as shaft bore 2 as shown in FIGS. 18A and 18B.

Figure 18A:
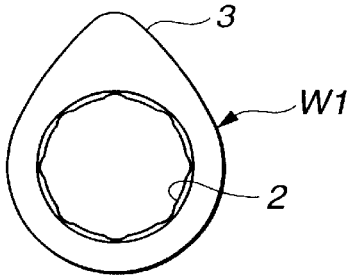
FIG. 18A is a side view of the intermediately formed body obtained at the piercing step in FIGS. 1B and 1C.
Figure 18B:
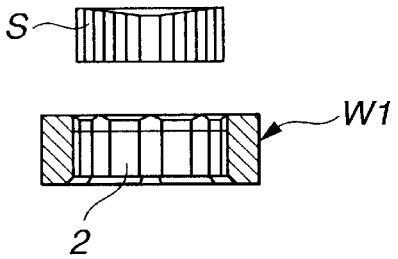
FIG. 18B is a sectional view of the intermediately formed body of FIG. 18A, also showing a scrap obtained at the piercing step.
Figure 19:
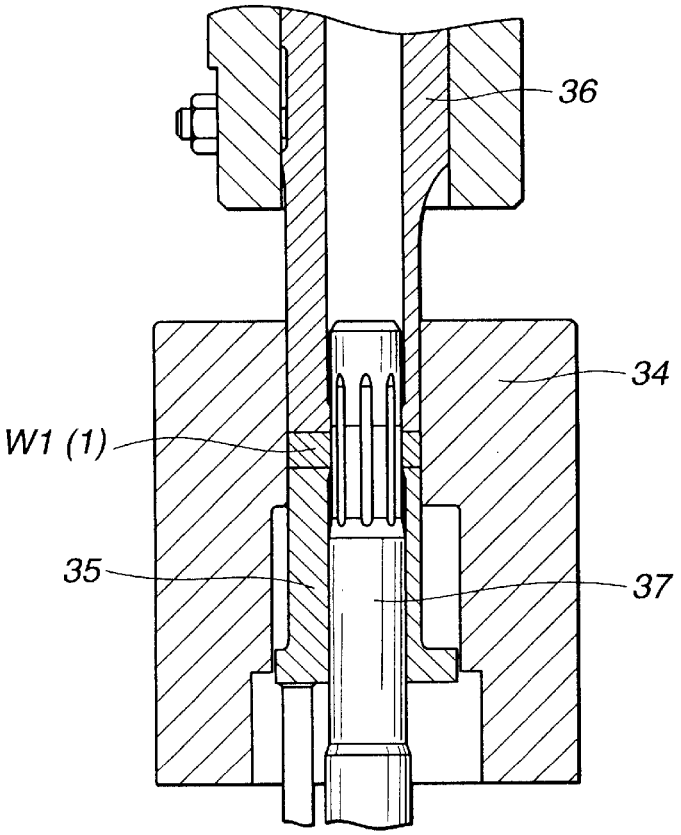
FIG. 19 is a fragmentary sectional view showing the working at an inner peripheral ironing step in FIGS. 1B and 1C.
Figure 20A:
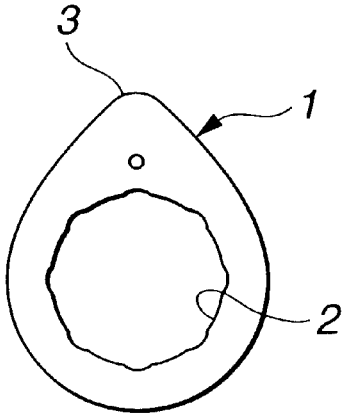
FIG. 20A is a side view of the cam lobe piece which has been completed after being subjected to the inner peripheral ironing step.
Figure 20B:
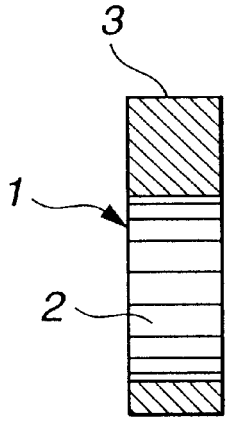
FIG. 20B is a cross-sectional view of the cam lobe piece of FIG. 20A.
Figure 21:
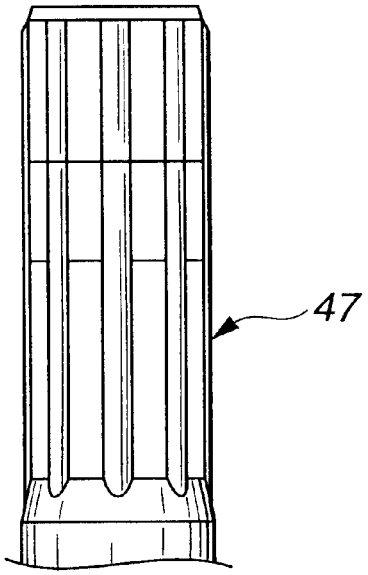
FIG. 21 is a fragmentary front view showing another example of a counter punch which is usable in the inner peripheral ironing step.

FIG. 19 illustrates the inner peripheral ironing step in which the intermediately formed body W1 as shown in FIGS. 18A and 18B is located in die 34, upon which counter punch 37 of the shape of the splined shaft is press-fitted into shaft bore 2 in order to make the inner peripheral ironing, so that shaft bore 2 is finished to have a regular shape or the shape of the splined bore. As a result, cam lobe piece 1 as shown in FIGS. 20A and 20B is obtained. It will be understood that counter punch 47 as shown in FIG. 21 may be used in place of counter punch 37 as shown in FIG. 19.

Next, another embodiment of the producing method of the cam lobe piece, according to the present invention will be discussed with reference to FIGS. 1B and 1C and FIGS. 22 to 32C. In this embodiment, the forming at the respective steps shown in FIGS. 1B and 1C are carried out by multi-stage cold former 50 of a so-called laterally punching type in which compressive forces exerted through the die to the material are applied laterally or horizontally.

Multi-stage cold former 50 includes bolster 51 as a main section and includes a section for accomplishing a cutting step S1 for cutting out the material Wc of the deformed shape as shown in FIG. 2A, from a coiled material, a section for accomplishing the primary forming step S2 in the profile forming step, a section for accomplishing the secondary forming step S3 in the profile forming step; a section for accomplishing the correcting step S4, a section for accomplishing the piercing step S5, a section for accomplishing the inner peripheral ironing step S6, and a section for accomplishing a work ejecting step S7. It will be understood that the primary forming step, the secondary forming step, the profile forming step, the correcting step, the piercing step and the inner peripheral ironing step of this embodiment are substantially the same as those shown in FIGS. 1B and 1C. In the producing method according to the present invention, it has been previously taken into consideration that the outer peripheral dimension of cam lobe piece 1 gradually increases as the degree of completion of the cam lobe piece becomes high through some steps shown in FIGS. 1B and 1C.

The section for accomplishing the cutting step S1 includes a cutter 52 for cutting the coiled material (the coiled material itself will be discussed after) supplied in a direction perpendicular to the surface of FIG. 22 thereby obtaining the material Wc of the deformed shape as shown in FIG. 2A. Additionally, a gripper 53 is disposed close to cutter 52 so as to grip the material Wc obtained after the cutting. The sections for accomplishing the primary forming step S2, the secondary forming step S3, the correcting step S4, the piercing step S5 and the inner peripheral ironing step S6 include respectively dies 54. Additionally, the section for accomplishing the final work ejecting step S7 includes ejection punch 55 which is adapted to be projectable in a direction perpendicular to the surface of FIG. 22. Multi-stage cold former 50 is understood to be arranged such that the axes of the die and the punch in FIGS. 10, 13, 15, 17 and 19 extend in the horizontal direction, so that the punch opposed to each die is provided to a ram (not shown) which approaches to and separates from bolster 51 in the horizontal direction.

Conveying device 56 is disposed above bolster 51 so as to successively convey the intermediate formed bodies W1 formed at the respective steps S2 to S6. This conveying device 56 includes slider 58 which makes its horizontal reciprocating motion in accordance with operation of driving unit 57 whose main component is an air cylinder, a servo motor or the like. Five grippers 59A, 59B, 59C, 59D, 59E are installed to slider 58 so as to grip the intermediately formed body W1 or cam lobe piece 1. Each gripper 59A, 59B, 59C, 59D, 59E is located in front of the corresponding die 54 in such a manner as not to interface with the corresponding die. The stroke of the reciprocating motion of slider 58 and the distance between the adjacent grippers are so set as to be equal to the pitch of the sections for accomplishing the steps S2, S3, S4, S5, S6, S7. The multi-stage cold former provided with such a conveying device is disclosed in Japanese Patent Provisional Publication No. 11-47877.

Figure 22:
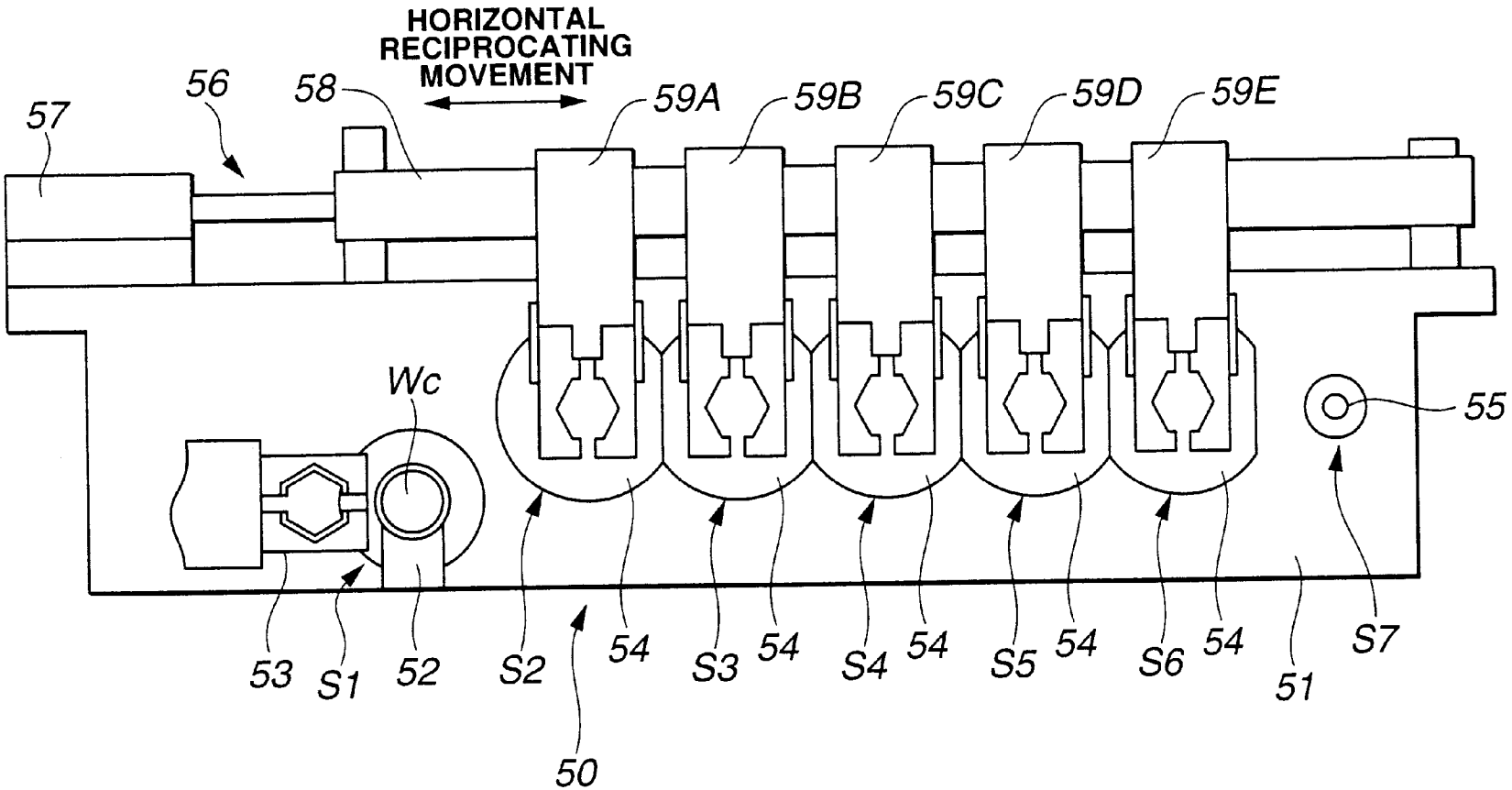
FIG. 22 is a schematic plan view of a multi-stage cold former of the laterally punching type for accomplishing a second embodiment of the production method of the cam lobe piece, according to the present invention.

On the assumption that the multi-stage cold former in FIG. 22 is in a conveying stand-by state, the intermediate formed bodies W1 which have been completed in forming at the respective steps S2 . . . S6 are gripped by the respectively gripers 59A . . . 59E in their conveying stand-by positions. Thereafter, grippers 59A . . . 59E are simultaneously moved to the next sections for accomplishing the next steps, so that the intermediate formed bodies W1 are conveyed respectively to the next sections for accomplishing the next steps. The respective grippers 59A . . . 59E temporarily stand by in the next sections for accomplishing the next steps until the forming at the next steps are completed. When the forming at the next steps have been completed, the respective grippers 59A . . . 59E return into their conveying stand-by state or the positions shown in FIG. 22.

Grippers 53 disposed in the section for accomplishing the cutting step S1 also operates in timed relation to each gripper 59*a* . . . 59E so as to serve to grip the deformed-shape material Wc cut out from the coiled material by cutter 52 at the cutting step S1 as discussed after, and to convey the material Wc to the section for accomplishing the primary forming step S2.

Figure 23:
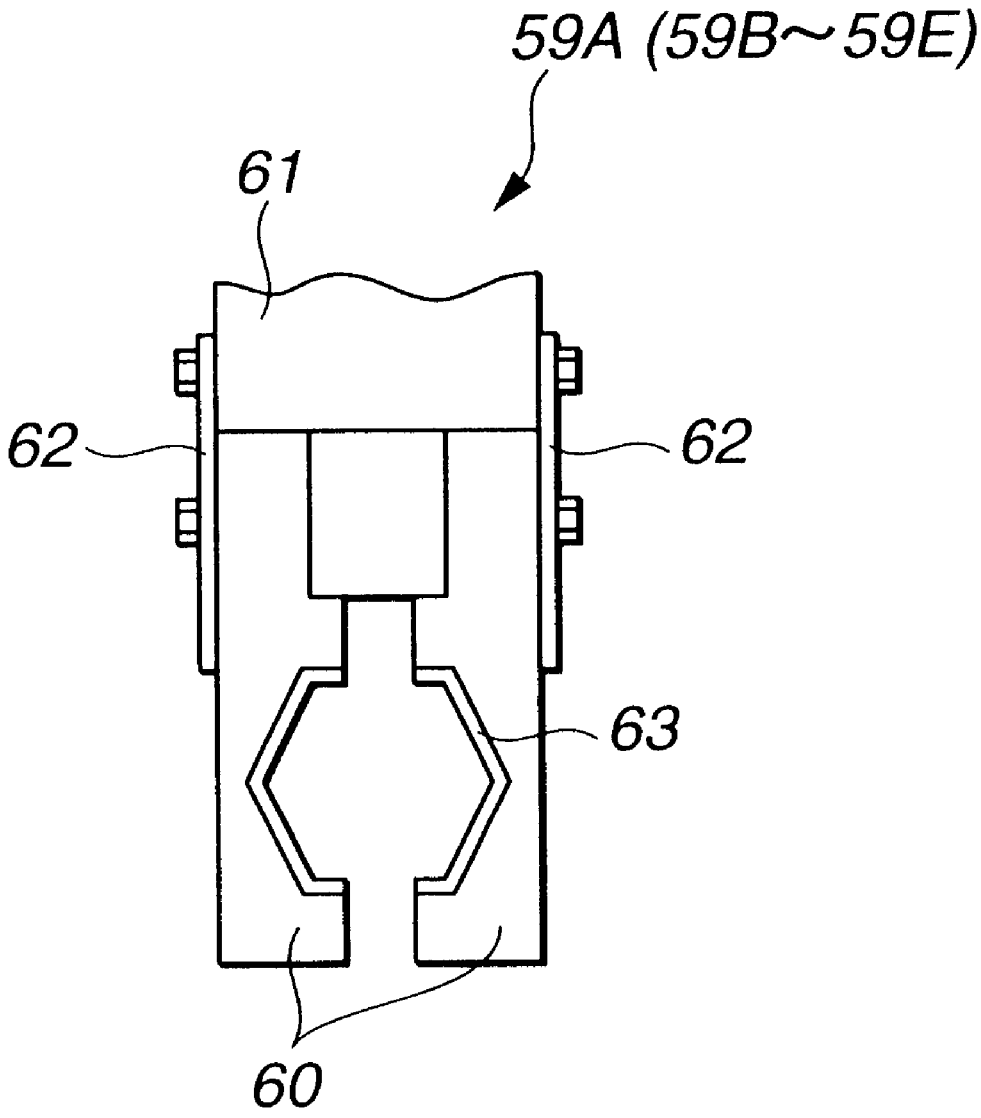
FIG. 23 is an enlarged fragmentary view of a gripper of the multi-stage cold former of FIG. 22.

As illustrated in FIG. 23, each gripper 53, 59A . . . 59E includes a pair of claw pieces 60 which are swingable and movable to approach to or separate from each other. Each claw piece 60 is connected to gripper main body 61 through plate spring 62, so that each gripper is adapted to grip the intermediately formed body W1 or cam lobe piece 1 with a grasping force decided by the spring constants of plate springs 62. Relatively large generally C-shaped chamfer 63 is formed at the gripping surface of each claw piece 60. By virtue of chamfer 63, when the punch having a diameter larger a certain amount than that of the intermediately formed body W1 gripped by the claw pieces 60 advances toward the gripped intermediately formed body W1, the punch is allowed to push the claw pieces 60 outward thereby separating the claw pieces 60 and to push out the intermediately formed body W1.

It is to be noted that as the working progresses successively from the primary forming step S2 to the inner peripheral ironing step, the peripheral (profile) dimension or shape of the intermediately formed body W1 gradually and stepwise increases. This has been previously set. Accordingly, each gripper 59A . . . 59E has been previously arranged to have a margin for gripping in order to be able to grip the intermediate formed bodies W1 having different peripheral (profile) dimensions or shapes.

Operation of the above-discussed multi-stage cold former 50 will be explained in detail, for example, regarding the primary forming step as a representative example, with reference to FIGS. 24A to 24D.

Figure 24A:
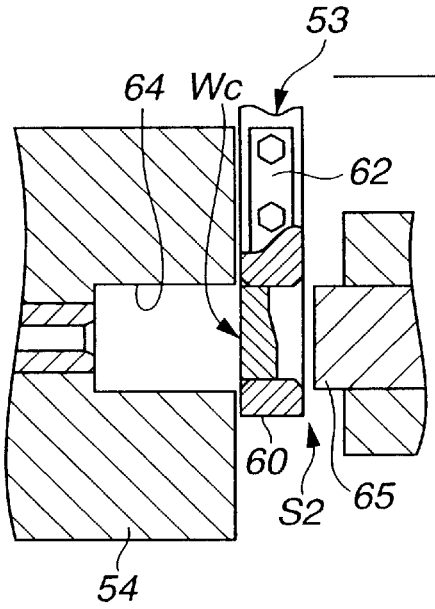
FIGS. 24A to 24D are fragmentary sectional views of a part of the multi-stage cold former, illustrating the movements of the material or intermediately formed body between a die and the gripper.
Figure 24B:
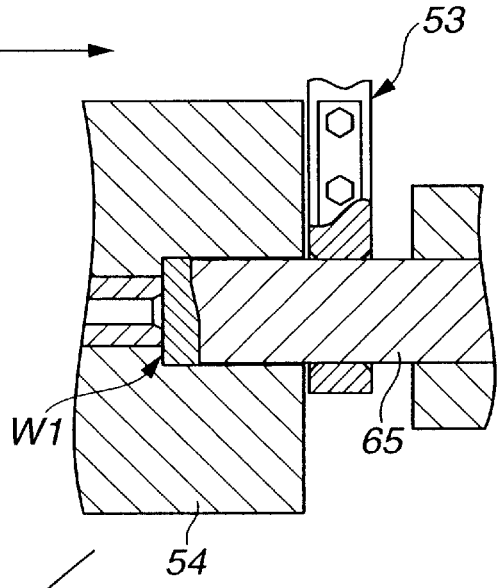
Figure 24C:
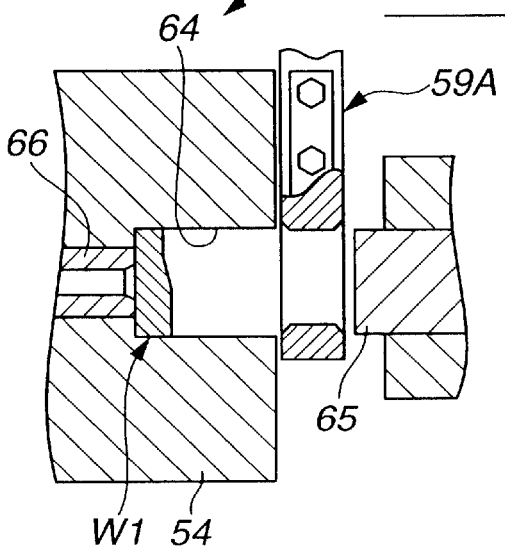
Figure 24D:
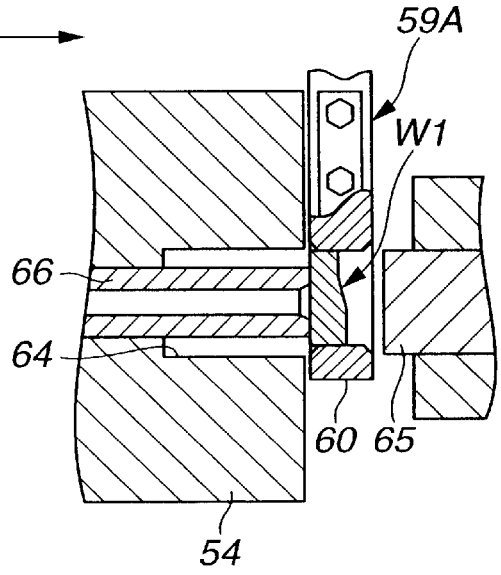

As illustrated in FIG. 24A, the deformed-shape material Wc upon being cut is conveyed in the condition of being gripped by gripper 53 to the die at the primary forming step S2 and positioned there in timed relation to the reciprocating motion of slider 58. In other words, the positioning is made such that cavity or impression 64 of die 54 and the profile of the material Wc gripped by gripper 53 coincide with each other. Then, when punch 65 of the section for accomplishing the primary forming step S2 makes its advancing movement, punch 65 pushes the claw pieces 60 aside and pushes the material Wc into cavity 64, thereby accomplishing the primary forming of the material Wc as shown in FIG. 24B and similarly to that in the state as shown in FIG. 10.

Upon completion of the primary forming of the material W, first punch 65 is withdrawn, and then all the grippers including gripper 53 and 59A . . . 59E are simultaneously returned to their initial positions under the reciprocating motion of slider 58, in which none of grippers 59A . . . 59E grips the material Wc or the intermediately formed body W1. By this, gripper 59A is positioned to the section for accomplishing the primary forming step S2, in place of gripper 53. In this state, knock-out punch (or knock-out pin) 66 makes its advancing motion thereby pushing out the intermediately formed body W1 within depression 64, and claw pieces 60 of gripper 59A are moved aside with the intermediately formed body W1 thereby causing the intermediately formed body W1 upon being subjected to the primary forming to be gripped by gripper 59A. When gripper 59A grips the intermediately formed body W1, knock-out punch 66 immediately returns to its initial position.

This state is the same as that of FIG. 24A with the exception that gripper 59A is operated in place of gripper 53. Accordingly, when slider 58 of conveying device 56 makes the next conveying operation, the intermediately formed body W1 (after the primary forming) gripped by gripper 59A is conveyed to the next section for accomplishing the next secondary forming step S3.

Figure 25:
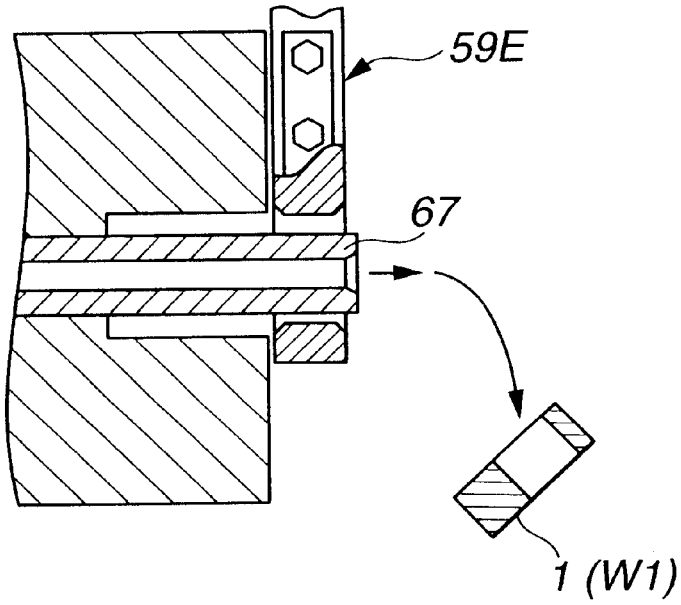
FIG. 25 is a fragmentary sectional view of a part of the multi-stage cold former, illustrating the working at a work ejecting step.

A series of operations as shown in FIGS. 24A to 24D are basically similarly made also in each of steps S3 . . . S6 other than the primary forming step S2, so that the operations for all the steps S1 . . . S7 are parallelly carried out in timed relation to each other. At the work ejecting step S7, as shown in FIG. 25, work ejection punch 67 makes its forward movement in timed relation to the forward movement of knock-out punch 66 at each step S2 . . . S6, thereby pushing out cam lobe piece 1 (See FIGS. 1B and 1C) which has been subjected to the inner peripheral ironing. Then, the cam lobe piece released from gripper 58E is recovered as the final product.

Figures 26A, 26B:
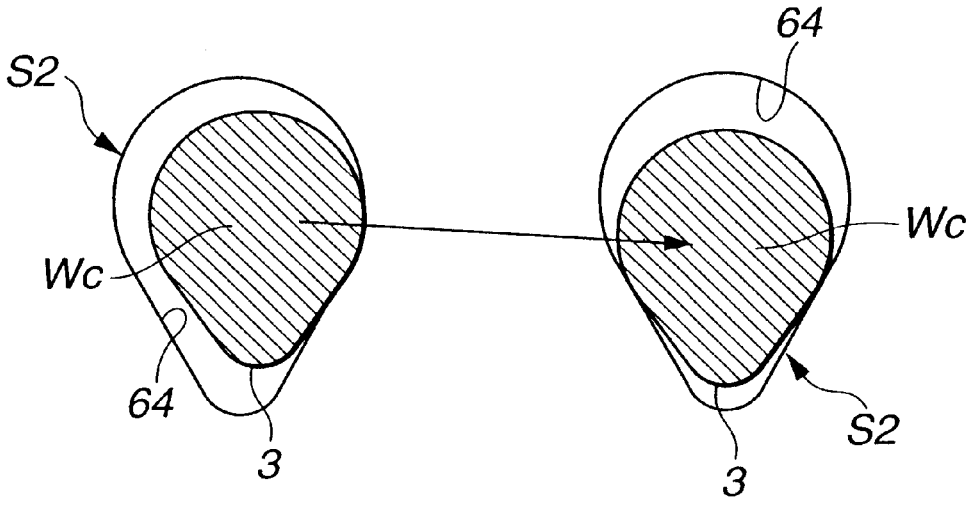
FIG. 26A is an explanatory view for illustrating the locational relationship between a cavity of the die and the material, at a first state during the primary forming step.
FIG. 26B is an explanatory view similar to FIG. 26A but illustrating the locational relationship at a second state after the first state of FIG. 26A.

Here, as illustrated in FIGS. 26A and 26B, cavity 64 of the die 54 used in each step S2 . . . S6 is set to have such a posture that a portion of the cavity 64 corresponding to cam nose 3 and serving to form cam nose 3 projects downward. In connection with this posture of cavity 64, the posture of the material Wc or the intermediately formed body W1 during conveying by gripper 53 and conveying device 56 has been previously set such that cam nose 3 projects downward.

This will be discussed on an example of the primary forming step as illustrated in FIGS. 24A to 24D. When the material Wc of the deformed shape is pushed into cavity 64 while being released from gripper 53 under the push-up action of punch 65, the material Wc drops a slight amount β by its self-weight the moment that the material Wc is released from gripper 53 as shown in FIGS. 26A, 26B and 27A to 27C, so that the material Wc can be immediately brought into fit with the portion (corresponding to the cam nose) of cavity 64 under the action of the profile that the cam nose (3) side of the material Wc projects downward, thereby exhibiting a so-called self-locating function or an automatic centering function.

Figure 27A:
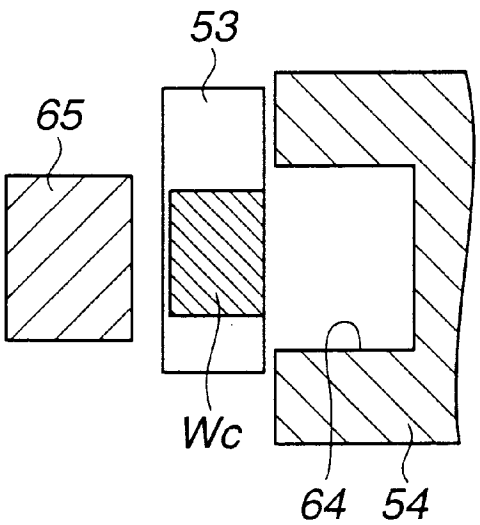
FIGS. 27A to 27C are fragmentary sectional views of a part of the multi-stage cold former, illustrating the locational relationship between the cavity of the die and the material during the primary forming step, in which the states of FIGS. 27B and 27C correspond respectively to those of FIGS. 26A and 26B.
Figure 27B:
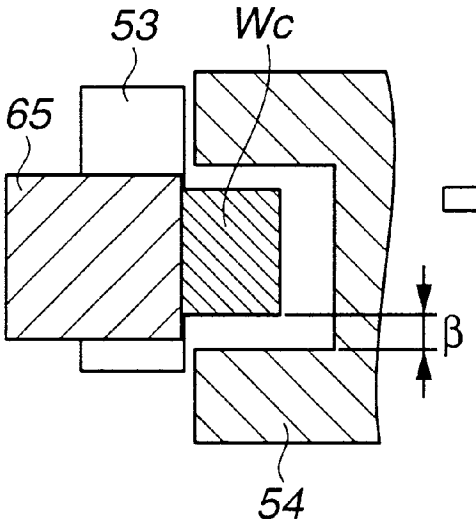
Figure 27C:
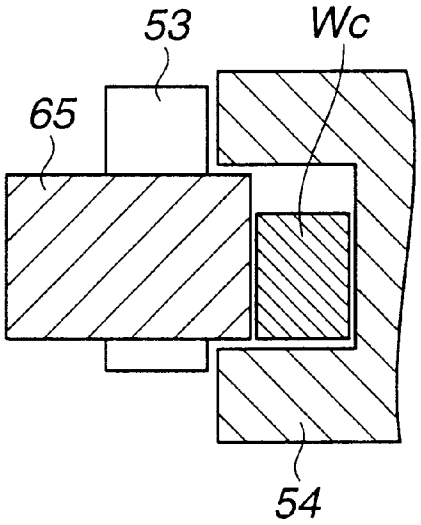

More specifically, as illustrated in FIGS. 27A to 27C, the moment that the deformed-shape material Wc gripped by gripper 53 is pushed out by the punch 65 and released from the gripping force of the gripper, the material Wc drops the slight amount β by its self-weight. Consequently, the side of cam nose 3 is immediately brought into fit with the portion (corresponding to cam nose) of cavity 64, so that the material Wc is thrust into the bottom side of cavity 64 in its state in which the material distribution is substantially one-sided to the side of cam nose 3, upon which the primary forming is accomplished.

As a result, the material distribution is one-sided to the side of cam nose 3 in the material Wc since a considerably earlier time than a time when the pressure of punch 65 is applied to the material Wc. This means that the side of cam nose 3 has been previously preferentially filled with the fillet of the material, so that the side of cam nose 3 can be sufficiently filled with the material although it has conventionally seemed difficult to fill such a pointed section in addition to the fact that cold forging is employed, thereby preventing one-sided fillet and underfill at the side of cam nose 3 thus contributing to improvements in forging quality.

Figures 28A, 28B:
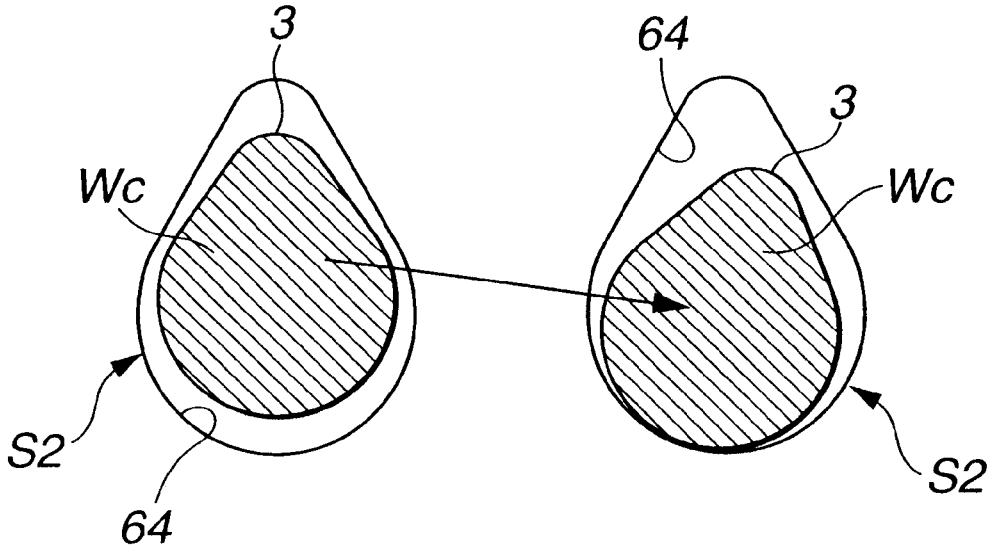
FIG. 28A is an explanatory view similar to FIG. 26 but illustrating the locational relationship between the cavity of the die and a material at the first state, in case that the upper side and lower side of the cavity and the material are reversed to those in FIG. 26A.
FIG. 28B is an explanatory view similar to FIG. 28A but illustrating the locational relationship at a second state after the first state of FIG. 28A.
Figures 29A, 29B:
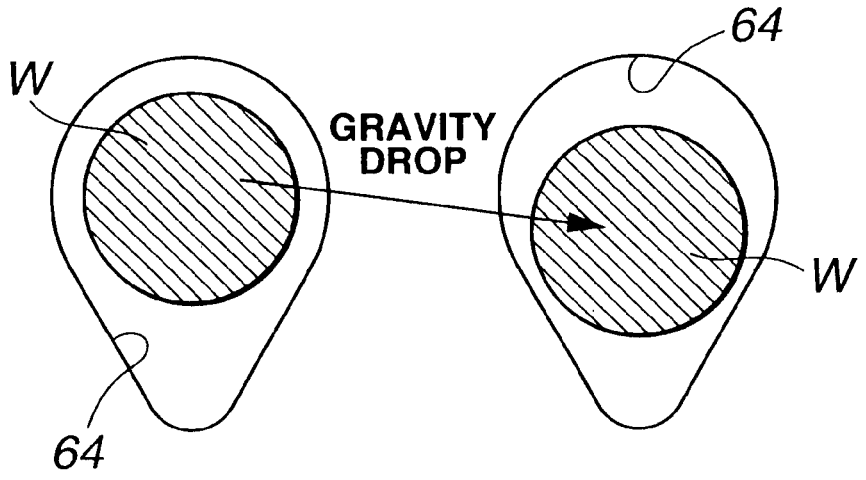

In other words, as illustrated in FIGS. 28A and 28B, in case that cavity 64 of each die 54 is set to have such a posture that the portion of the cavity 64 corresponding to cam nose 3 projects upward, the tumbling-down phenomena of the material Wc is made within cavity 64 the moment that the material drops by its self-weight, so that the one-sided fillet and underfill tend to occurs at the side of cam nose 3 because of insufficient material at the side of cam nose 3. It will be appreciated that such drawbacks can be effectively overcome according to the above embodiment of the present invention.

Although discussion of the behavior of the material Wc shown in FIGS. 26A, 26B and 27A to 27C has been made on the example of the primary forming step S2, it will be understood that the behavior of the material Wc or the intermediately formed body W1 at other steps is basically similar to that at the primary forming step S2. Even if the column-like material W is used in place of the material Wc of the deformed shape, it is the matter of course to similarly pay a large attention onto the material distribution for the side of the cam nose 3 as appreciated from FIGS. 29A and 29B.

Consideration will be made on the relationship, for example, between cavity 64 of the section for accomplishing the primary forming step S2 and cavity 64 of the section for accomplishing the secondary forming step S3 with reference to FIG. 30. It is the premise that the intermediately formed body W1 is conveyed horizontally and parallelly from the section for accomplishing the primary forming step S2 as the former step to the section for accomplishing the secondary step S3 as the latter step, and therefore the gravity centers G of the both sections which are adjacent to each other are coincident with each other. Accordingly, as shown in FIGS. 26A, 26B and 27A to 27C, when the intermediately formed body W1 is thrust into cavity 64 in the section for accomplishing the secondary forming step S3, the intermediately formed body W1 drops by the certain amount β by its self-weight.

Figure 31:
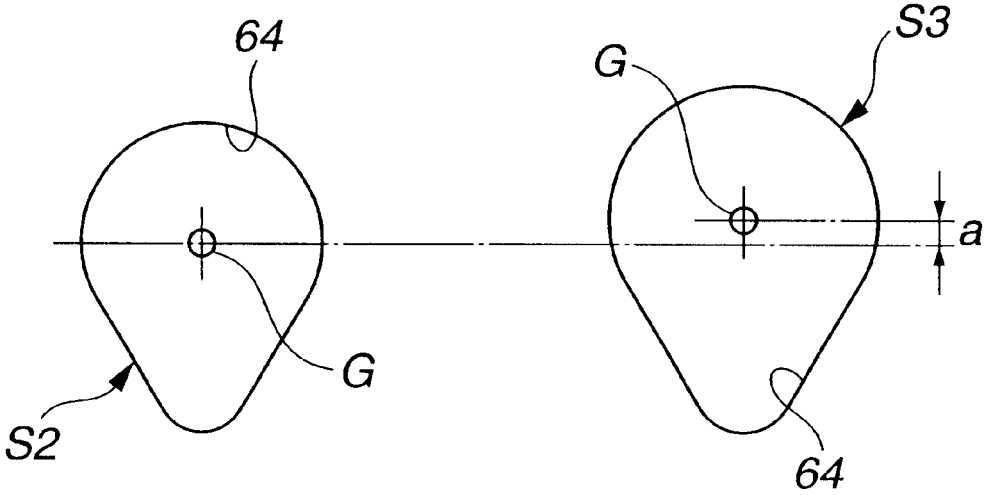
FIG. 31 is an explanatory view illustrating an improved relative location between the cavity of the section for accomplishing the primary forming step and the cavity of the section for accomplishing the secondary forming step, in the multi-stage cold former of FIG. 22, in case that the cavities of the sections are vertically offset to each other.
Figures 32A, 32B, 32C:
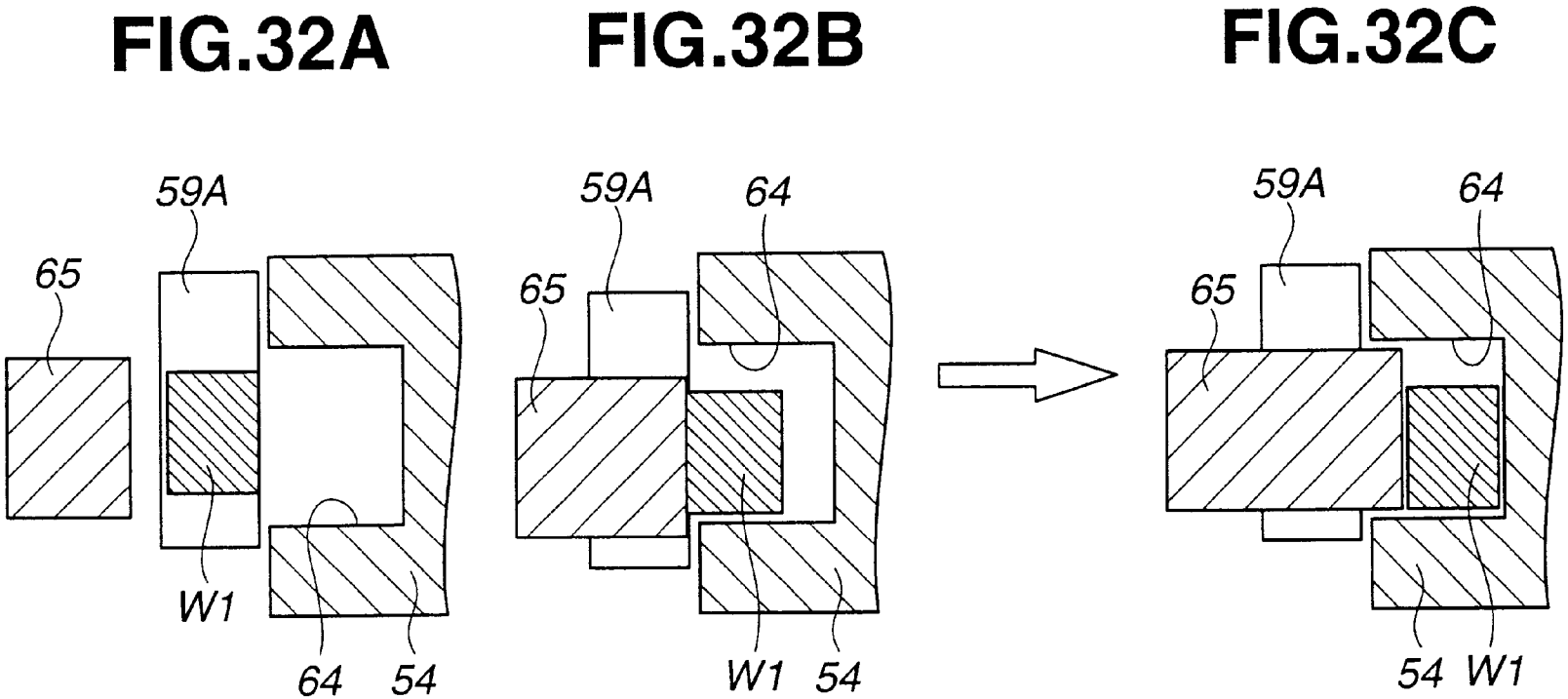
FIG. 32A is a fragmentary sectional view of a part of the multi-stage cold former, showing the locational relationship between the cavity of the die and the material at a first state during the primary forming step, in case of the arrangement of FIG. 31.
FIG. 32B is a fragmentary sectional view similar to FIG. 32A but showing the locational relationship at a second state during the primary forming step, after the first state of FIG. 32A.
FIG. 32C is a fragmentary sectional view similar to FIG. 32B but showing the locational relationship at a third state during the primary forming step, after the second state of FIG. 32B.

In view of the above, as shown in FIG. 31, the position of the gravity center G of cavity 64 of the section for accomplishing the secondary forming step S3 as the latter step is previously offset by a certain amount a (=β) relative to the gravity center G of cavity 64 of the section for accomplishing the primary forming step S2 as the former step, by which the drop amount β of the intermediately formed body W1 by the self-weight can be cancelled. In other words, as illustrated in FIGS. 32A to 32C, at a stage in which the intermediate formed member W1 conveyed from the section for accomplishing the primary forming step S2 has been gripped by gripper 59A, the height positions of cam nose 3 of the intermediately formed body W1 and that of the portion (corresponding to the cam nose) of cavity 64 are brought into coincidence with each other. Consequently, cavity 64 and the intermediately formed body W1 are in a mutual relation in which no drop of the offset amount β by the self-weight occurs, in which the side of cam nose 3 is brought into a state in which the material distribution is preferential or one-side there, thereby further improving the accuracy in relative location between the intermediately formed body W1 and cavity 64.

Figure 30:
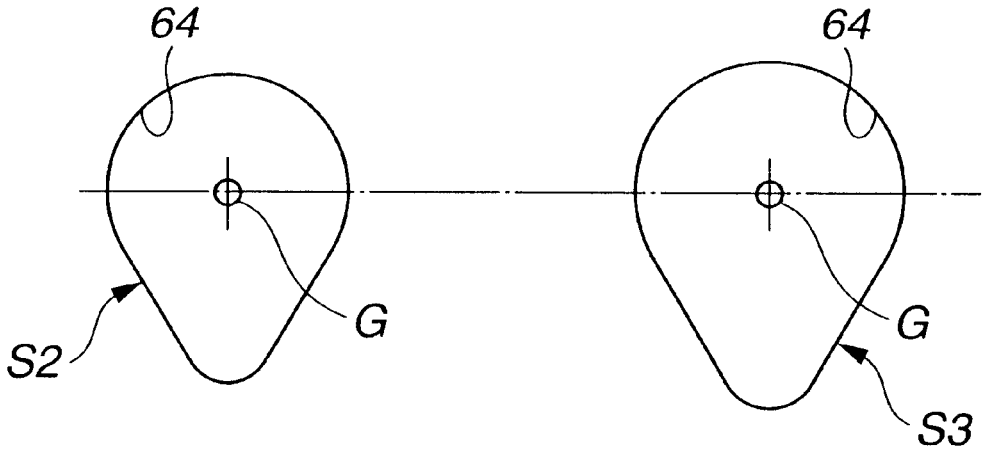
FIG. 30 is an explanatory view illustrating the relative location between the cavity of a section for accomplishing the primary forming step and the cavity of a section for accomplishing the secondary forming step, in the multi-stage cold former of FIG. 22.

Here, even in case that the above-mentioned offset amount a in FIG. 31 is not set between cavity 64 of the section for accomplishing the primary forming step S2 as the former stet and the cavity 64 of the section for accomplishing the secondary forming step S3 as the latter step as illustrated in FIG. 30, similar effects in the above can be obtained by setting the conveyed posture of the intermediately formed body W1 in a state in which the side of cam nose 3 projects downward, or by making such an arrangement as to positively cause the intermediately formed body W1 to descend (offset) by an amount equal to the above offset amount a during the conveying step from the primary forming step S2 to the secondary forming step S3.

The offset amount a (=β) between cavities 64 for the former and latter steps and the offset amount a during the conveying step are similarly set for the other successive steps S4 . . . S6.

Next, a preferable mode of the coiled material of the deformed (cross-sectional) shape to be supplied to multi-stage cold former 50 as shown in FIG. 22 will be discussed with reference to FIGS. 33 to 35.

Figure 33:
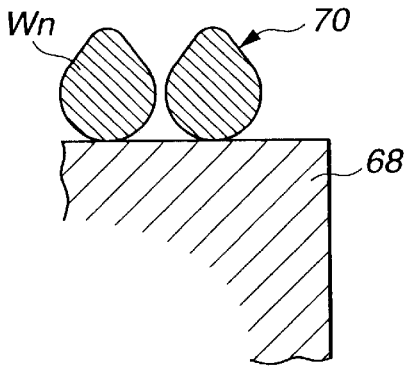
FIG. 33 is a fragmentary sectional view of a coiled material before being cut as the material of the deformed shape, wound on a drum.

The rod-like material Wn as shown in FIG. 3, for example, produced by the continuous casting is wound up on certain drum 68 in such a manner that the a surface opposite to a surface on the side of cam nose 3 becomes inside as illustrated in FIG. 33, thereby preparing the coiled material 70. The coiled material 70 is set on uncoiler 71 disposed in front of multi-stage cold former 50 as illustrated in FIG. 34. The reason why the rod-like material Wn is wound up in a state where the side of cam nose 3 is located outside as shown in FIG. 33 is as follows: If the rod-like material Wn is wound up in a state where the side of cam nose 3 is located inside, the contact area of the rod-like material Wn to drum 68 is small and therefore unstable, and therefore there is the fear that the side of cam nose 3 (the most important in function) is deformed. The coiled material 70 is uncoiled by uncoiler 71 and supplied though straightening device 72 to multi-stage cold former 50 so that the coiled material 70 is successively fed out from the die of the section for accomplishing the cutting step S1 in FIG. 22.

Figure 34:
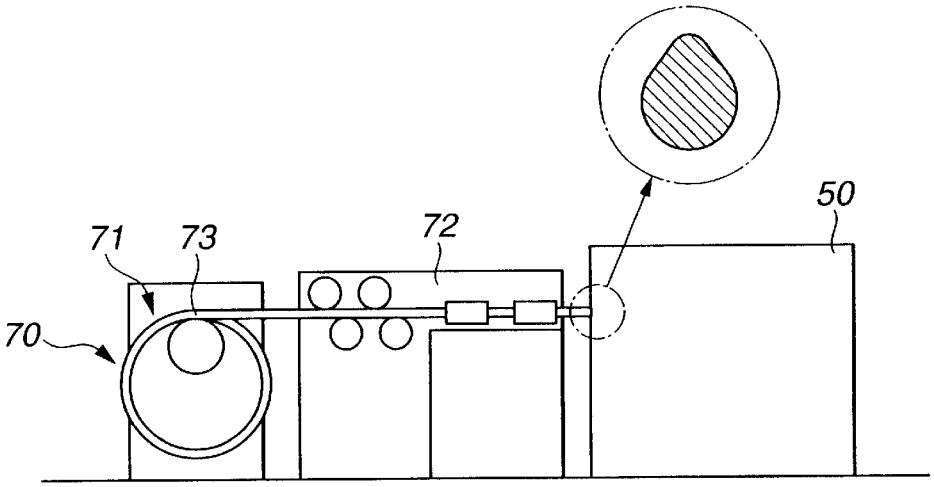
FIG. 34 is a side view of a production system including an uncoiler to which the coiled material is set in a conventional state.

In this case, if the coiled material 70 is set on uncoiler 71 in such a state where a starting position 73 for unwinding the coiled material 70 is located at the upper side of uncoiler 71 as shown in FIG. 34, the side of cam lobe 3 is unavoidably located upward at a starting (tip) end of the unwound coiled material 70 (Wn) as indicated as an enlarged cross-section in a broken circle in FIG. 34, and therefore this posture of the coiled material 70 (Wn) does not corresponds to such an ideal posture (in which the side of cam nose 3 projects downward) in the above-discussed cold forging by multi-stage cold former. Accordingly, it is required to reverse the posture of the material 70 before the material Wn is conveyed to the section for accomplishing the primary forming step S2, which is not preferable.

Figure 35:
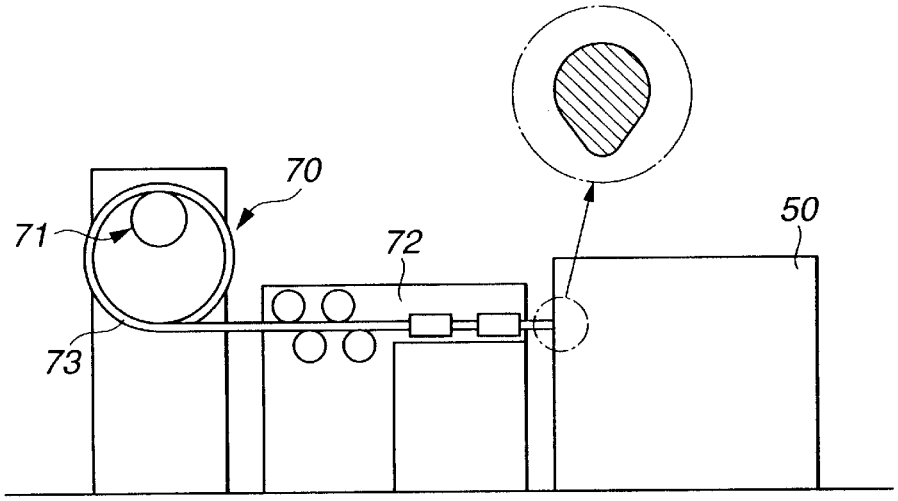
FIG. 35 is a side view of a production system including an uncoiler to which the coiled material is set in a state employed in the second embodiment production method.

In view of this, it is preferable to set the coiled material 70 on uncoiler 71 in such a state where starting position 73 for unwinding coiled material 70 is located at the lower side of uncoiler 71 as shown in FIG. 35. With this arrangement, the side of cam lobe 3 projects downward at a starting (tip) end of the unwound coiled material 70 (Wn) as indicated as an enlarged cross-section in a broken line in FIG. 35, and therefore this posture of the coiled material 70 (Wn) corresponds to such an ideal posture (in which the side of cam nose 3 projects downward) in the above-discussed cold forging by multi-stage cold former.

As appreciated from the above, according to the present invention, the production method of the cam lobe piece includes at least the profile forming step, the piercing step and the inner peripheral ironing step as a premise, and the shape of the intermediately formed body at the primary forming step as an intermediate step in the profile forming step is such that the thickness of the intermediately formed body gradually increases toward its section on the side of the cam nose of the cam lobe piece. As a result, flow of fillet of the material is promoted in the long diameter direction of the cam lobe piece while the flow speed of the fillet of the material is relatively increased at the section on the cam nose side so that the material can be smoothly filled to the section on the cam nose side. Accordingly, even the cam nose having a small radius of curvature can be easily formed without occurrence of underfill and the like. Besides, load necessary for filling the fillet of the material to the section on the cam nose side can be effectively reduced thereby achieving lightening the load applied to the die and prolonging the life of the die.

The entire contents of Japanese Patent Applications P2002-15229 (filed Jan. 24, 2002) and P2002-154988 (filed May 29, 2002) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A method of producing a cam lobe piece of an assembled camshaft, comprising:

forming a profile of the cam lobe piece by upsetting a material in a direction of thickness of the cam lobe piece under forging to obtain an intermediately formed body;

piercing a central portion of the intermediately formed body to form a shaft bore in the intermediately formed body; and ironing an inner peripheral surface of the pierced intermediately formed body to form unevenness at the inner peripheral surface, wherein the forming the profile of the cam lobe piece, the piercing the central portion of the intermediately formed body and the ironing the inner peripheral surface of the pierced intermediately formed body are accomplished by cold working, wherein the material at the forming the profile of the cam lobe piece has a shape including first and second side surfaces which are opposite to each other in the direction of thickness of the cam lobe piece, the first side surface including first and second surface portions which are substantially parallel with the second side surface, the first surface portion forming part of a first section located on a side of a cam nose of the cam lobe piece, the second surface portion forming part of a second section which is located longitudinally opposite to the first section, the first surface portion being farther from the second side surface than the second surface portion so that a thickness of the material gradually increases in a direction from the second section to the first section.

2. A method as claimed in claim 1, wherein the forming the profile of the cam lobe piece includes primarily forming the profile of the cam lobe piece to obtain the intermediately formed body, and secondarily forming the profile of the cam lobe piece, wherein the intermediately formed body after the primarily forming the profile of the cam lobe piece has a shape including first and second side surfaces which are opposite to each other in the direction of thickness of the cam lobe piece, the first side surface including first and second surface portions which are substantially parallel with the second side surface, the first surface portion forming part of a first section located on a side a cam nose of the cam lobe piece, the second surface portion forming part of a second section which is located longitudinally opposite to the first section, the first surface portion being farther from the second side surface than the second surface portion so that a thickness of the intermediately formed body gradually increases in a direction from the second section to the first section.

3. A method of producing a cam lobe piece of an assembled camshaft, comprising:

forming a profile of the cam lobe piece by upsetting a material in a direction of thickness of the cam lobe piece under forging to obtain an intermediately formed body;

piercing a central portion of the intermediately formed body to form a shaft bore in the intermediately formed body; and ironing an inner peripheral surface of the pierced intermediately formed body to form unevenness at the inner peripheral surface, wherein the forming the profile of the cam lobe piece, the piercing the central portion of the intermediately formed body and the ironing the inner peripheral surface of the pierced intermediately formed body are accomplished by cold working, wherein the material to be supplied for the forming the profile of the cam lobe piece has a section corresponding a cam nose of the cam lobe piece, the section having a rounded end portion having a radius of curvature substantially equal to that of a rounded end portion of the cam nose of the cam lobe piece, the radius of curvature of the material being formed prior to the forming the profile of the cam lobe piece.

4. A method as claimed in claim 3, wherein the section corresponding to the cam nose of the cam lobe piece has an opening angle substantially equal to that of the cam nose of the cam lobe piece, the opening angle of the material being formed prior to the forming the profile of the cam lobe piece.

5. A method as claimed in claim 4, wherein the material to be supplied for the forming the profile of the cam lobe piece has a cross-section similar to that of the cam lobe piece, the material having long and short diameters which are in a ratio substantially equal to that of long and short diameters of the cam lobe piece.

6. A method as claimed in claim 1, wherein the forming the profile of the cam lobe piece, the piercing the central portion of the intermediately formed body and the ironing the inner peripheral surface of the pierced intermediately formed body are included in a multiple step forging press working as a basic working.

7. A method as claimed in claim 1, wherein the material is a steel selected from the group consisting of a low carbon steel and a low carbon alloy steel, wherein the material is subjected to carburizing after the cold working including the forming the profile of the cam lobe piece, the piercing the central portion of the intermediately formed body, and the ironing the inner peripheral surface of the pierced intermediately formed body.

8. A method of producing a cam lobe piece of an assembled camshaft, comprising:

forming a profile of the cam lobe piece by upsetting a material in a direction of thickness of the cam lobe piece under forging to obtain an intermediately formed body;

piercing a central portion of the intermediately formed body to form a shaft bore in the intermediately formed body; and ironing an inner peripheral surface of the pierced intermediately formed body to form unevenness at the inner peripheral surface, wherein the material has a first section located on a side of a cam nose of the cam lobe piece, and a second section longitudinally opposite to the first section, wherein each of the forming the profile of the cam lobe piece, the piercing the central portion of the intermediately formed body and the ironing the inner peripheral surface of the pierced intermediately formed body is carried out in a condition where the first section of the material is located below relative to the second section of the material under a cold working and by using a multi-stage former in which compressive forces are applied laterally to the material.

9. A method as claimed in claim 8, wherein the forming the profile of the cam lobe piece includes primarily forming the profile of the cam lobe piece to obtain the intermediately formed body, and secondarily forming the profile of the cam lobe piece.

10. A method as claimed in claim 8, further comprising conveying the material between two of the forming the profile of the cam lobe piece, the piercing the central portion of the intermediately formed body, and the ironing the inner peripheral surface of the pierced intermediately formed body, the two being successively carried out, the conveying the material being carried out in a condition where the first section of the material is located below relative to the second section of the material.

11. A method as claimed in claim 8, wherein two of the forming the profile of the cam lobe piece, the piercing the central portion of the intermediately formed body, and the ironing the inner peripheral surface of the pierced intermediately formed body are respectively accomplished successively as former and latter steps, wherein a cross-sectional area corresponding to the profile of the cam lobe piece, of the material is larger at the latter step than that at the former step, wherein the method further comprising causing the first section of the material to be brought into fit with a corresponding part of a cavity of a die, prior to the latter step in which the intermediately formed body is thrust into the cavity of the die, the corresponding part corresponding to the cam nose of the cam lobe piece.

12. A method as claimed in claim 11, wherein the causing the first section of the material to be brought into fit with the corresponding part of the cavity of the die includes upwardly offsetting by an amount a position of center of gravity of the cavity of the die used at the latter step relative to a position of center of gravity of the cavity of the die used at the former step, prior to the forming the profile of the cam piece.

13. A method as claimed in claim 11, wherein the causing the first section of the material to be brought into fit with the corresponding part of the cavity of the die includes downwardly moving by an amount a position of center of gravity of the intermediately formed body in a step of conveying the intermediately formed body from the former step to the latter step.

14. A method as claimed in claim 8, further comprising supplying a coiled material to the multi-stage former at an initial step of the method so that cutting of the coiled material is carried out by the multi-stage former to form the material, the supplying the coiled material to the multi-stage former including setting the coiled material wound in a state where the first section is located at an outer peripheral side relative to the second section on an uncoiler in such a manner that a starting position for unwinding the coiled material is located at a lower side of the uncoiler, and supplying the coiled material to the multi-stage former while unwinding the coiled material.

* * * * *